US011773844B2

(12) United States Patent
Pham et al.

(10) Patent No.: US 11,773,844 B2
(45) Date of Patent: Oct. 3, 2023

(54) RECIPROCATING PUMP TRUNNIONS CONNECTING CROSSHEAD AND CONNECTING ROD

(71) Applicant: Schlumberger Technology Corporation, Sugar Land, TX (US)

(72) Inventors: Hau Nguyen-Phuc Pham, Houston, TX (US); Rod Shampine, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 120 days.

(21) Appl. No.: 16/895,194

(22) Filed: Jun. 8, 2020

(65) Prior Publication Data

US 2020/0386222 A1 Dec. 10, 2020

Related U.S. Application Data

(60) Provisional application No. 62/858,748, filed on Jun. 7, 2019.

(51) Int. Cl.

| | |
|---|---|
| ***F04B 53/16*** | (2006.01) |
| ***F04B 53/18*** | (2006.01) |
| ***F04B 53/14*** | (2006.01) |
| ***F04B 53/00*** | (2006.01) |
| ***F04B 9/02*** | (2006.01) |

(52) U.S. Cl.

CPC ..... *F04B 53/16* (2013.01); *F04B 53/14* (2013.01); *F04B 53/18* (2013.01); *F04B 9/02* (2013.01); *F04B 53/006* (2013.01)

(58) Field of Classification Search

CPC ..... F04B 53/006; F04B 53/14; F04B 53/144; F04B 53/147; F04B 53/16; F04B 53/18; F04B 9/02; F04B 9/04

See application file for complete search history.

(56) References Cited

U.S. PATENT DOCUMENTS

| | | | |
|---|---|---|---|
| 7,172,175 | B2 | 2/2007 | Vicars |
| 7,335,002 | B2 | 2/2008 | Vicars |
| 7,341,435 | B2 | 3/2008 | Vicars |
| 8,276,918 | B1 | 10/2012 | Gilstad et al. |
| 8,662,864 | B2 | 3/2014 | Bayyouk et al. |
| 8,662,865 | B2 | 3/2014 | Bayyouk et al. |
| 9,435,333 | B2 | 9/2016 | McCoy et al. |
| 9,435,454 | B2 | 9/2016 | Blume |

(Continued)

FOREIGN PATENT DOCUMENTS

| | | |
|---|---|---|
| CN | 106337804 A | 1/2017 |
| WO | 9950578 | 10/1999 |

(Continued)

OTHER PUBLICATIONS

Office Action issued in U.S. Appl. No. 16/895,107 dated May 9, 2023, 32 pages.

*Primary Examiner* — Grant Moubry
*Assistant Examiner* — Ruben Picon-Feliciano
(74) *Attorney, Agent, or Firm* — Jeffrey D. Frantz

(57) ABSTRACT

A crosshead assembly for a reciprocating pump. The crosshead assembly has a crosshead and a connecting rod configured to connect with a crankshaft of the reciprocating pump. Trunnions detachably connect with the connecting rod and facilitate pivotable connection of the connecting rod and the crosshead.

20 Claims, 16 Drawing Sheets

(56) References Cited

U.S. PATENT DOCUMENTS

| | | | | |
|---|---|---|---|---|
| 9,500,195 | B2 | 11/2016 | Blume | |
| 9,605,767 | B2 | 3/2017 | Chhabra | |
| 9,989,053 | B2 | 6/2018 | Ladd et al. | |
| 10,087,992 | B2 | 10/2018 | Bayyouk et al. | |
| 10,871,227 | B1 | 12/2020 | Belshan et al. | |
| 2008/0006148 | A1* | 1/2008 | McKelroy | F16J 7/00 92/190 |
| 2012/0234539 | A1* | 9/2012 | Brunet | F01M 9/02 166/285 |
| 2015/0132157 | A1 | 5/2015 | Whaley et al. | |
| 2016/0025082 | A1 | 1/2016 | Byrne et al. | |
| 2016/0177945 | A1 | 6/2016 | Byrne et al. | |
| 2016/0369792 | A1* | 12/2016 | Wagner | F04B 53/22 |
| 2017/0159655 | A1 | 6/2017 | Morreale et al. | |
| 2017/0218951 | A1 | 8/2017 | Graham et al. | |
| 2017/0292513 | A1 | 10/2017 | Haddad et al. | |
| 2017/0370524 | A1 | 12/2017 | Wagner | |
| 2018/0040226 | A1 | 2/2018 | Zhang et al. | |
| 2018/0087503 | A1* | 3/2018 | Chunn | F04B 9/045 |
| 2018/0135621 | A1 | 5/2018 | Blume | |
| 2018/0156212 | A1 | 6/2018 | Ballario | |
| 2018/0216613 | A1 | 8/2018 | Beisel | |
| 2018/0230977 | A1 | 8/2018 | Skurdalsvold et al. | |
| 2018/0291892 | A1 | 10/2018 | Vicars | |
| 2019/0011051 | A1 | 1/2019 | Yeung | |
| 2019/0055939 | A1 | 2/2019 | Buckley | |
| 2019/0136840 | A1 | 5/2019 | Kumar et al. | |

FOREIGN PATENT DOCUMENTS

| | | | |
|---|---|---|---|
| WO | 2015077252 | A1 | 5/2015 |
| WO | 2017039701 | A1 | 3/2017 |
| WO | 2018052398 | A1 | 3/2018 |
| WO | 2018075055 | A1 | 4/2018 |
| WO | 2019046680 | A1 | 3/2019 |

* cited by examiner

RECIPROCATING PUMP TRUNNIONS CONNECTING CROSSHEAD AND CONNECTING ROD

RELATED APPLICATION

This application claims priority to and the benefit of a U.S. Provisional Application having Ser. No. 62/858,748, filed 7 Jun. 2019, which is incorporated by reference herein.

BACKGROUND OF THE DISCLOSURE

High-volume, high-pressure pumps are utilized at wellsites for a variety of pumping operations. Such operations may include drilling, cementing, acidizing, water jet cutting, hydraulic fracturing, and other wellsite operations. For example, one or more positive displacement reciprocating pumps may be utilized to pressurize low-pressure fluid from one or more mixers, blenders, and/or other fluid sources for injection into a well.

Each reciprocating pump may comprise a plurality of reciprocating, fluid-displacing members (e.g., pistons, plungers, diaphragms, etc.) driven by a crankshaft into and out of a fluid-pressurizing chamber to alternatingly draw in, pressurize, and expel fluid from the fluid-pressurizing chamber. Each reciprocating member discharges the fluid from its fluid-pressurizing chamber in an oscillating manner, resulting in suction and discharge valves of the pump alternatingly opening and closing during pumping operations.

Success of pumping operations at a wellsite may be affected by many factors, including efficiency, failure rates, and safety related to operation of the reciprocating pumps. Vibration and repetitive high forces and pressures generated by the reciprocating pumps may cause mechanical fatigue, wear, and/or other damage to the pumps, which may decrease pumping flow rates, quality of downhole operations, and/or operational efficiency.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus including a crosshead assembly for a reciprocating pump. The crosshead assembly includes a crosshead, a connecting rod configured to connect with a crankshaft of the reciprocating pump, and trunnions detachably connected with the connecting rod and facilitating pivotable connection of the connecting rod and the crosshead.

The present disclosure also introduces an apparatus including a crosshead assembly for a reciprocating pump. The crosshead assembly includes a crosshead and a connecting rod pivotably connected with the crosshead and a crankshaft of the reciprocating pump. A fluid passage extends through the connecting rod.

The present disclosure also introduces an apparatus including a crosshead assembly for a reciprocating pump, the crosshead assembly including a crosshead and a connecting rod. The crosshead is slidably disposed within a housing of the reciprocating pump and includes a first crosshead surface slidably engaging the housing, a second crosshead surface, and a first fluid passage extending between the first and second crosshead surfaces. The connecting rod operatively connects a crankshaft of the reciprocating pump with the crosshead. The connecting rod includes a first connecting rod surface pivotably engaging the first crosshead surface, a second connecting rod surface pivotably engaging the crankshaft, and a second fluid passage extending between the first and second connecting rod surfaces. The first and second fluid passages are connected and transfer a lubricant.

The present disclosure also introduces an apparatus including a reciprocating pump including a housing, a crankshaft, and a crosshead assembly. The housing includes an inner housing surface, an outer housing surface, and a fluid port extending between the inner and outer housing surfaces. The crosshead assembly includes a crosshead and a connecting rod. The crosshead is slidably disposed within the housing and includes a first crosshead surface slidably engaging the inner housing surface, a second crosshead surface, and a first fluid passage extending between the first and second crosshead surfaces. The fluid port and the first fluid passage are fluidly connected. The connecting rod operatively connects the crankshaft with the crosshead and includes a first connecting rod surface pivotably engaging the first crosshead surface, a second connecting rod surface pivotably engaging the crankshaft, and a second fluid passage extending between the first and second connecting rod surfaces. The first and second fluid passages are fluidly connected, and the fluid port and the first and second fluid passages transfer a lubricant.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
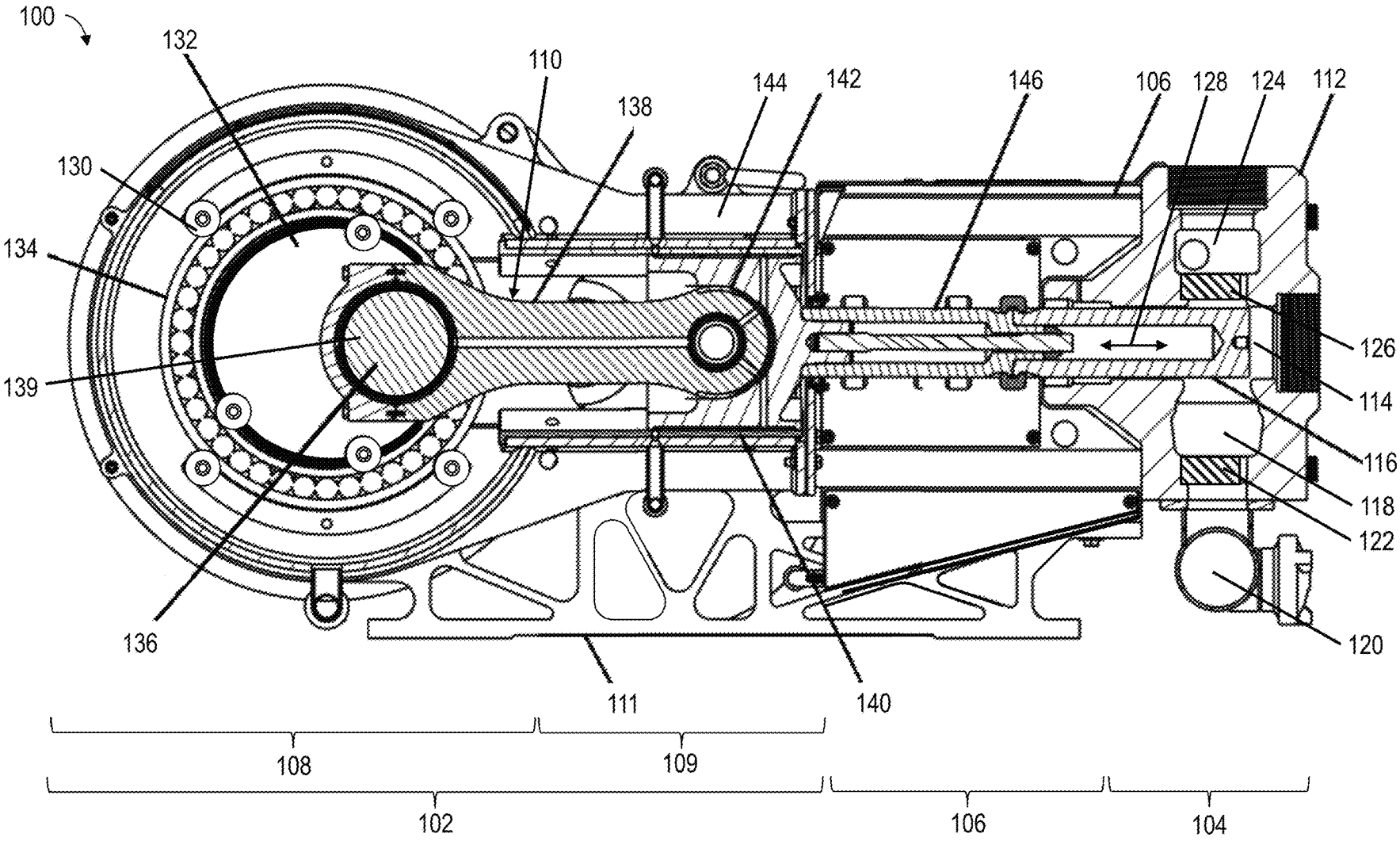
FIG. 1 is a sectional side view of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure is directed or otherwise related to structure and operation of a positive displacement reciprocating pump. The pump may be utilized or otherwise implemented for pumping a fluid at an oil and gas wellsite, such as for pumping a fluid into a well. For example, a pump according to one or more aspects of the present disclosure may be utilized or otherwise implemented in association with a well construction system (e.g., a drilling rig) to pump a drilling fluid through a drill string during well drilling operations. A pump according to one or more aspects of the present disclosure may also or instead be utilized or otherwise implemented in association with a well fracturing system to pump a fracturing fluid into a well during well fracturing operations. A pump according to one or more aspects of the present disclosure may also or instead be utilized or otherwise implemented in association with a well cementing system to pump a cement slurry into a well during casing cementing operations. However, a pump according to one or more aspects of the present disclosure may also or instead be utilized or otherwise implemented for performing other pumping operations at an oil and gas wellsite and/or other worksites. For example, a pump according to one or more aspects of the present disclosure may be utilized or otherwise implemented for performing acidizing, chemical injecting, and/or water jet cutting operations. Furthermore, a pump according to one or more aspects of the present disclosure may be utilized or otherwise implemented at mining sites, building construction sites, and/or other work sites at which fluids are pumped at high volumetric rates and/or pressures.

FIG. 1 is a sectional side of at least a portion of an example implementation of a positive displacement reciprocating pump 100 according to one or more aspects of the present disclosure. The pump 100 comprises a power section 102 connected with and operable to actuate a fluid section 104 (e.g., fluid end). The power section 102 and the fluid section 104 may be connected via a spacer frame 106. The power section 102 may comprise a crankcase 108 operatively connected with a prime mover (e.g., engine, electric motor, etc.) (not shown) and a crosshead section 109 housing a plurality of crosshead assemblies 110. The crankcase 108 may be operable to transfer torque from the prime mover to the crosshead assemblies 110, which transform and transmit torque from the crankcase 108 to reciprocating linear forces causing pumping operation to be performed by the fluid section 104.

The fluid section 104 may comprise a pump housing 112 having a plurality of fluid-pressurizing chambers 114. One end of each fluid-pressurizing chamber 114 may contain a reciprocating, fluid-displacing member 116 slidably disposed therein and operable to displace a fluid within the corresponding fluid-pressurizing chamber 114. Although the fluid-displacing member 116 is depicted as a plunger, the fluid-displacing member 116 may instead be implemented as a piston, diaphragm, or other reciprocating, fluid-displacing member.

Each fluid-pressurizing chamber 114 comprises or is fluidly connected with a corresponding fluid inlet cavity 118 configured for communicating fluid from a common fluid inlet 120 (e.g., inlet manifold, suction manifold) into the fluid-pressurizing chamber 114. An inlet (i.e., suction) valve 122 may selectively fluidly isolate each fluid-pressurizing chamber 114 from the fluid inlet 120 to selectively control fluid flow from the fluid inlet 120 into each fluid-pressurizing chamber 114. Each inlet valve 122 may be disposed within a corresponding fluid inlet cavity 118 or otherwise between each fluid inlet cavity 118 and the corresponding fluid-pressurizing chamber 114. Each inlet valve 118 may be biased toward a closed-flow position by a spring and/or other biasing means (not shown). Each inlet valve 122 may be actuated to an open-flow position by a predetermined differential pressure between the corresponding fluid-pressurizing chamber 114 and the fluid inlet 120.

Each fluid-pressurizing chamber 114 may be fluidly connected with a common fluid outlet 124 (e.g., outlet manifold, discharge manifold). The fluid outlet 124 may be or comprise a fluid cavity extending through the pump housing 112 transverse to the fluid chambers 114. An outlet (i.e., discharge) valve 126 may selectively fluidly isolate each fluid-pressurizing chamber 114 from the fluid outlet 124 to selectively control fluid flow from each fluid-pressurizing chamber 114 into the fluid outlet 124. Each outlet valve 126 may be disposed within the fluid outlet 124 or otherwise between each fluid-pressurizing chamber 114 and the fluid outlet 124. Each outlet valve 126 may be biased toward a closed-flow position by a spring and/or other biasing means (not shown). Each outlet valve 126 may be actuated to an open-flow position by a predetermined differential pressure between the corresponding fluid-pressurizing chamber 114 and the fluid outlet 124.

During pumping operations, portions of the power section 102 may rotate in a manner that generates a reciprocating linear motion to longitudinally oscillate, reciprocate, or otherwise move each fluid-displacing member 116 within the corresponding fluid-pressurizing chamber 114, as indicated by arrows 128. Each fluid-displacing member 116 alternatingly decreases and increases pressure within each chamber 114, thereby alternatingly receiving (e.g., drawing) fluid into and discharging (e.g., displacing) fluid out of each fluid-pressurizing chamber 114.

The crankcase 108 may comprise a crankcase housing 130, a crankshaft 132, and rotational bearings 134 supporting the crankshaft 132 in position within the crankcase housing 130. The prime mover may be operatively connected with (perhaps indirectly) and drive or otherwise rotate the crankshaft 132. The crankshaft 132 may comprise a plurality of crankpins 136 (e.g., offset journals) radially offset from the central axis of the crankshaft 132.

The crosshead assemblies 110 operatively connect the crankshaft 132 and the fluid-displacing members 116, transforming and transmitting the rotational motion of the crankshaft 132 to a reciprocating linear motion of the fluid-displacing members 116. For example, each crosshead assembly 110 may comprise a connecting rod 138 pivotably (e.g., rotatably) coupled with a corresponding crankpin 136 at one end and with a crosshead 140 of the crosshead assembly 110 at an opposing end. An end cap or C-clamp 139 may pivotably couple the connecting rod 138 to the crankpin 136. Each connecting rod 138 may be pivotably coupled with a corresponding crosshead 140 via a wristpin joint 142. The crosshead section 109 may further comprise a crosshead support housing 144 (i.e., crosshead guide support frame) configured to support and guide sliding motion of each crosshead 140. During pumping operations, side walls and upper and lower friction pads of the crosshead support housing 144 may guide each crosshead 140 and prevent or inhibit vertical motion of each crosshead 140. The crankcase housing 130 and the crosshead support housing 144 may be integrally formed or otherwise fixedly connected. Each crosshead 140 may be coupled with the fluid-displacing member 116 via a connecting rod 146 (e.g., pony rod). Each connecting rod 146 may be coupled with a corresponding crosshead 140 via a threaded connection and with a corresponding fluid-displacing member 116 via a flexible connection.

A support frame 111 may be fixedly connected with the crankcase housing 130 and the crosshead support housing 144. The support frame 111 may be integrally formed with the crankcase housing 130 and with the crosshead support housing 144. The support frame 111 may extend along (e.g., underneath) and be fixedly connected with the spacer frame 106. The support frame 111 may structurally reinforce the crankcase housing 130, the crosshead support housing 144, and the spacer frame 106. The support frame 111 may prevent or inhibit transfer of torque and/or linear forces and, thus, prevent or inhibit relative movement between the crankcase housing 130, the crosshead support housing 144, the spacer frame 106, and the fluid section 104. The support frame 111 may be fixedly coupled to a base (not shown), such as a skid or mobile trailer, to fixedly connect the pump 100 to the base.

The pump 100 may be implemented as a triplex pump, which has three fluid-pressurizing chambers 114 and three fluid-displacing members 116. The pump 100 may instead be implemented as a quintuplex pump having five fluid-pressurizing chambers 114 and five fluid-displacing members 116. The pump 100 may instead be implemented as a multiplex pump comprising other quantities of fluid-pressurizing chambers 114 and fluid-displacing members 116.

Figure 2:
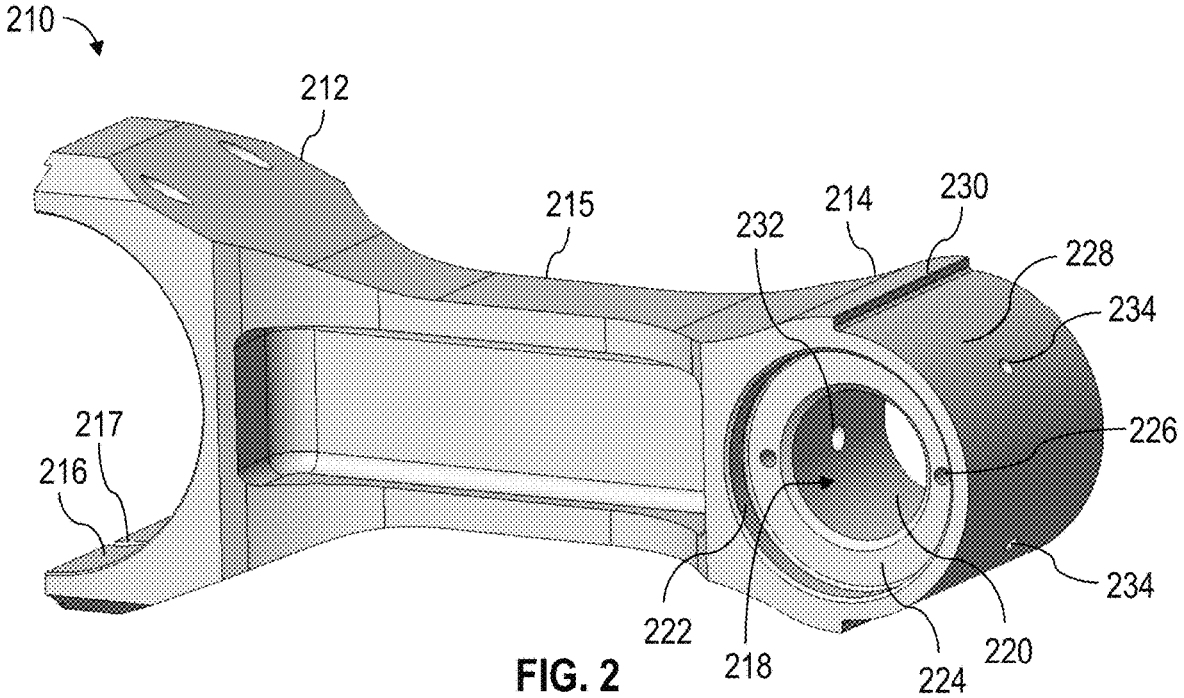
FIGS. 2-23 are views of various portions of the apparatus shown in FIG. 1 according to one or more aspects of the present disclosure.
Figure 3:
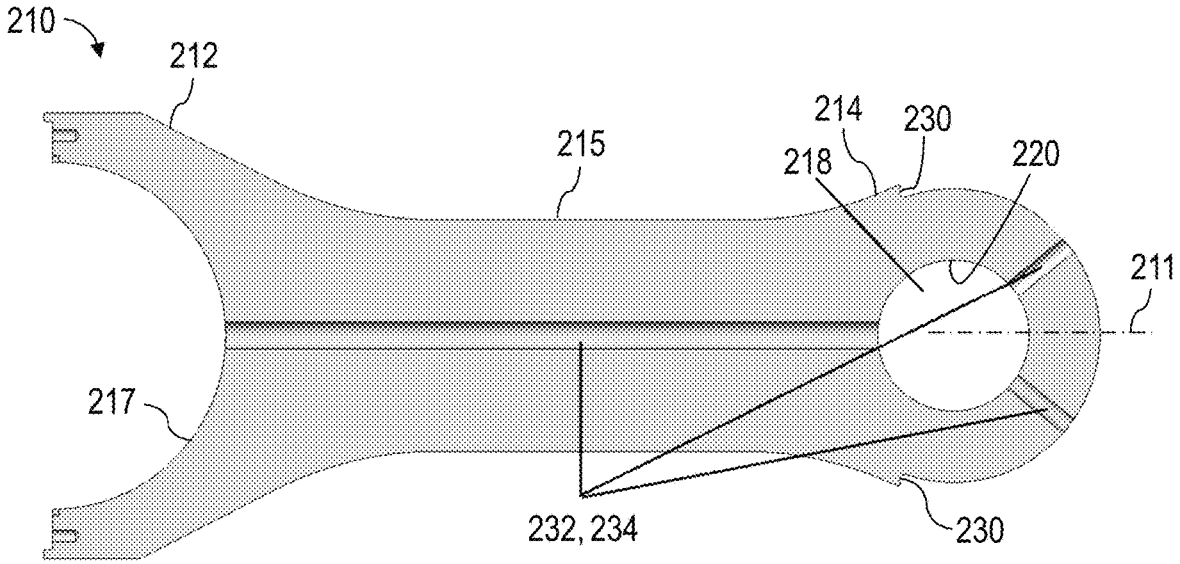

The present disclosure is further directed to or otherwise related to a crosshead assembly implemented as part of a positive displacement reciprocating pump, such as the pump 100, shown in FIG. 1. FIGS. 2 and 3 are perspective and side sectional views, respectively, of a connecting rod 210 of such crosshead assembly.

The connecting rod 210 may comprise a crankpin end 212 configured to be pivotably coupled with a crankpin of the pump and a wristpin end 214 configured to be pivotably coupled with a crosshead of the crosshead assembly. The crankpin end 212 may be connected with the wristpin end 214 by an elongated body 215, which may comprise an I-beam shaped cross-sectional profile. The crankpin end 212 may comprise an inner curved surface 216 (e.g., a cylindric section surface) configured to receive a portion of the crankpin. A rod cap or C-clamp may be positioned over the crankpin and connected with the crankpin end 212 via threaded or other fasteners to couple the connecting rod 210 to the crankpin. A channel 217 may extend circumferentially along a portion of the inner curved surface 216. A bore 218 may extend through the wristpin end 214 perpendicularly or otherwise laterally with respect to a longitudinal axis 211 of the connecting rod 210. The bore 218 may be defined by or comprise a smaller diameter portion 220 terminating on opposing sides with countersunk or otherwise larger diameter portions 222. Shoulders 224 between the smaller and larger diameter portions 220, 222 may have threaded fastener holes 226. The wristpin end 214 may further comprise an outer curved surface 228 (e.g., a cylindric section surface) terminating on opposing sides with shoulders 230 (i.e., wristpin end bushing stops). The connecting rod 210 may also comprise a pilot bore 232 extending longitudinally through the body 215 between the channel 217 along the surface 216 and the smaller diameter bore portion 220. The wristpin end 214 may comprise radial bores 234 extending between the smaller diameter bore portion 220 and the outer surface 228. The channel 217 and the bores 218, 232, 234 may collectively form or comprise a fluid passage configured to transfer a lubricant therethrough between the surfaces 216, 228.

Figure 4:
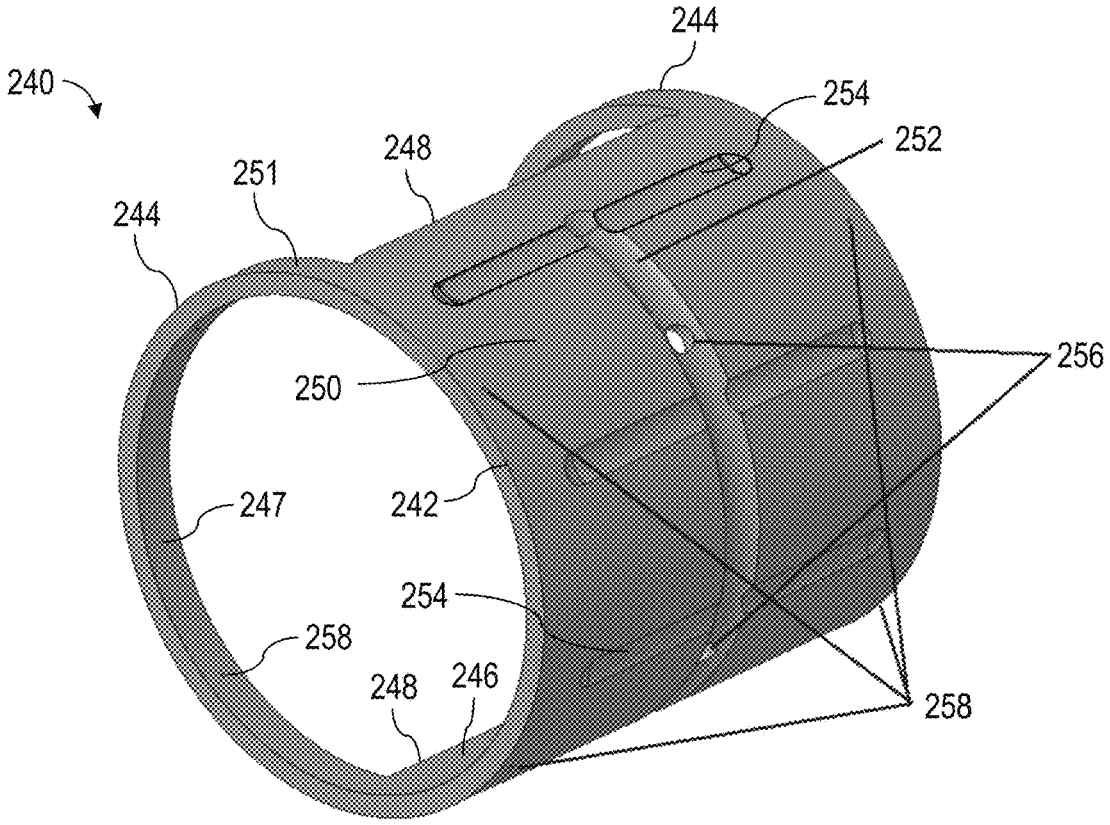
Figure 5:
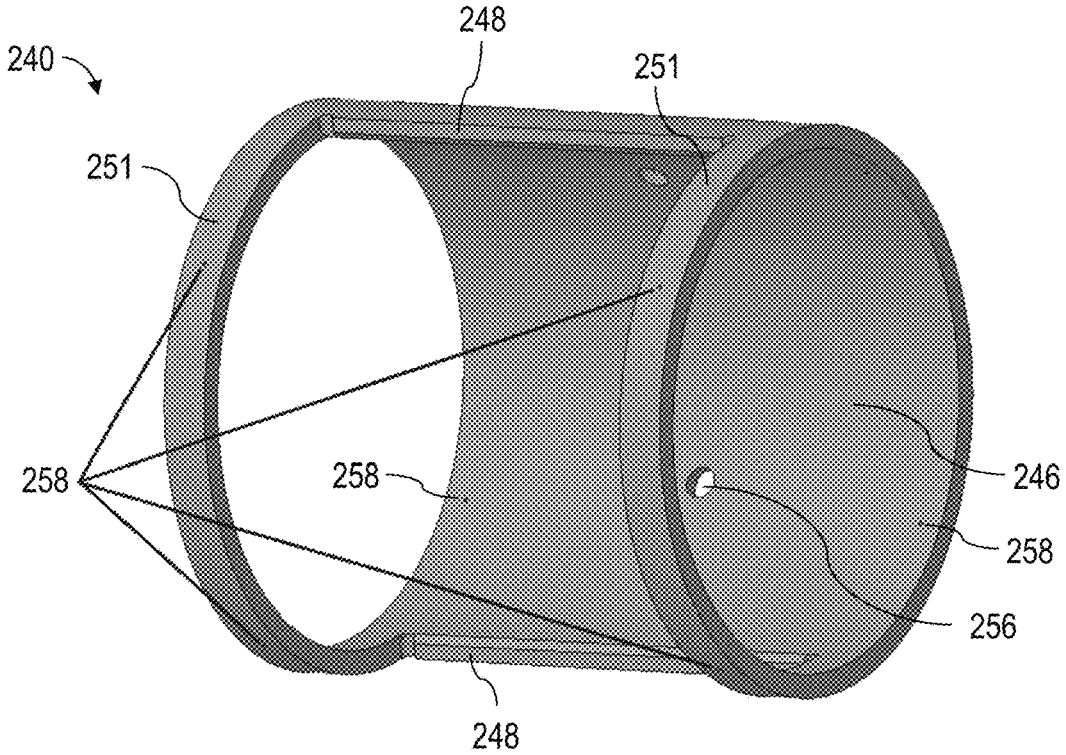

FIGS. 4 and 5 are perspective views of opposing sides of a wristpin end bushing 240 for the connecting rod 210 shown in FIGS. 2 and 3. The bushing 240 may be connected with or about the wristpin end 214 of the connecting rod 210. The bushing 240 may comprise a common bushing-type alloy, such as aluminum-bronze, Babbitt material, or brass, among other examples.

The bushing 240 may comprise a C-bushing portion 242 terminating on opposing sides with ring bushing portions 244. The bushing 240 may be a single-piece bushing, wherein the C-bushing portion 242 and the ring bushing portions 244 are integrally formed or otherwise connected. The C-bushing portion 242 of the bushing 240 may comprise a front inner curved surface 246 (e.g., a cylindric section surface) configured to abut or contact the outer curved surface 228 of the wristpin end 214. The C-bushing portion 242 may comprise end shoulders 248 configured to abut or contact the shoulders 230 of the wristpin end 214 to prevent or inhibit the bushing from pivoting with respect to the wristpin end 214. Each ring bushing portion 244 of the bushing 240 may comprise a rear inner curved surface 247 (e.g., a cylindric section surface). The C-bushing portion 242 of the bushing 240 may comprise a front outer curved surface 250 (e.g., a cylindric section surface). A plurality of circumferential and/or longitudinal channels 252, 254 may extend along the front outer curved surface 250. The channels 252, 254 may comprise semispherical cross-sections. Radial bores 256 may extend between the front inner curved surface 246 and the front outer surface 250 along the circumferential channel 252. The radial bores 256 may be aligned with the radial bores 234 of the connecting rod 210 when the bushing 240 is connected with the wristpin end 214. Each ring bushing portion 244 of the bushing 240 may comprise a rear outer curved surface 251 (e.g., a cylindric section surface). Radial bores 258 (e.g., pin holes) may extend between the rear inner curved surfaces 247 and the rear outer curved surfaces 251 of the ring bushing portions 244 and between the front inner curved surface 246 and the front outer curved surface 250 along the edges of the C-bushing portions 242. The bores 256, 258 and the channels 252, 254 may be configured to transfer lubricant therethrough.

Figure 6:
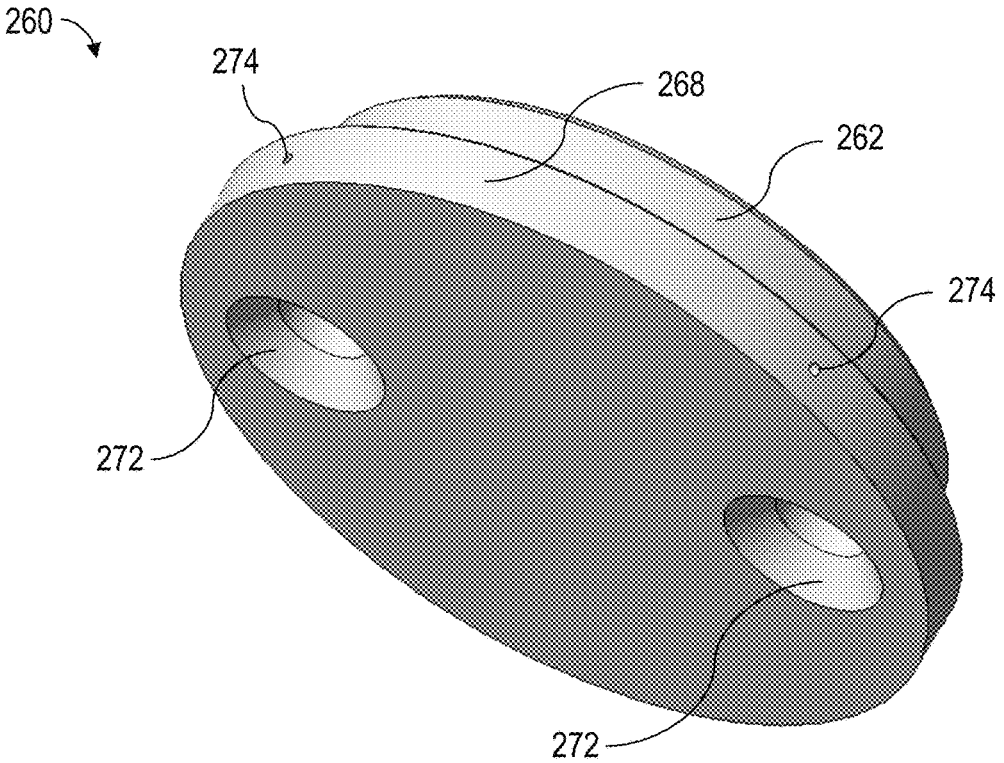
Figure 7:
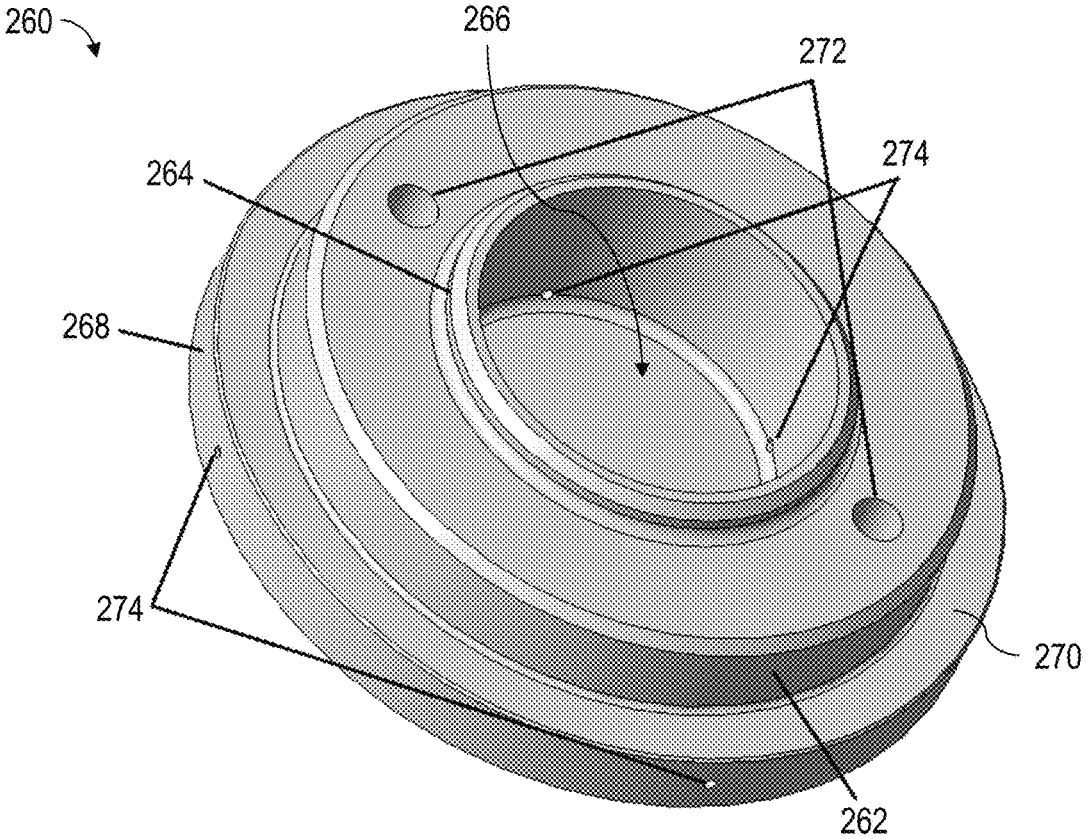
Figure 8:
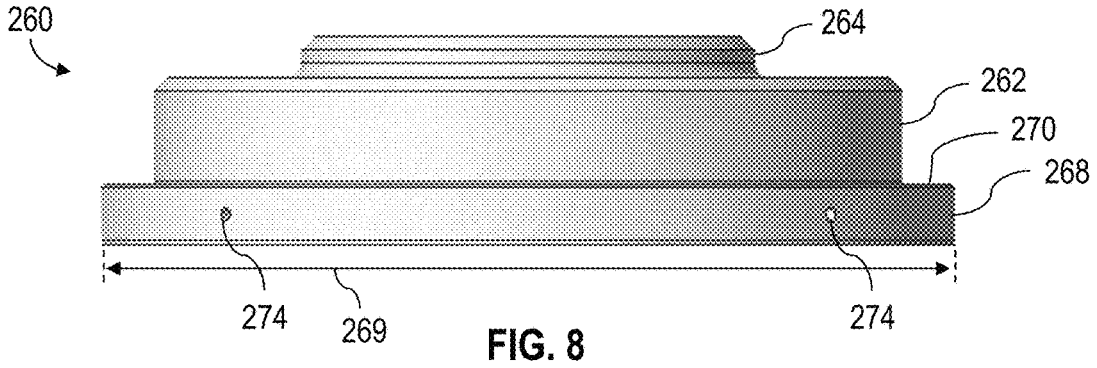
Figure 9:
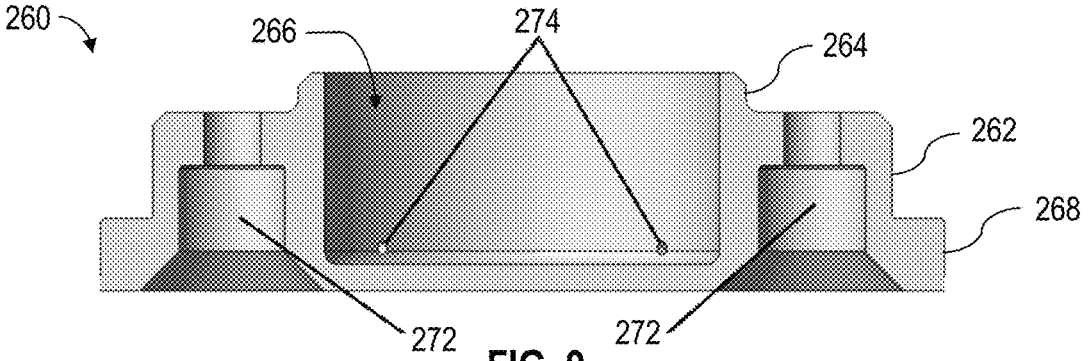
Figure 10:
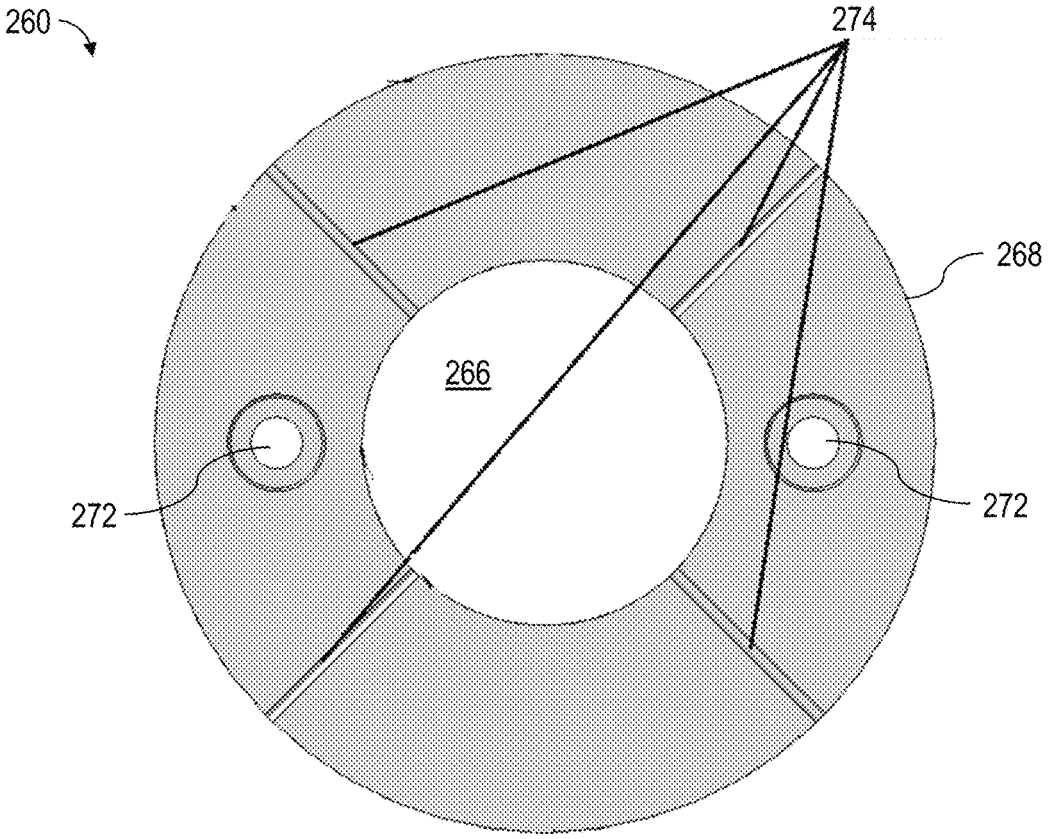

FIGS. 6 and 7 are perspective views of opposing sides of a trunnion 260 forming a portion of and detachably connectable with the connecting rod 210 shown in FIGS. 2 and 3. FIG. 8 is a side view the trunnion 260. FIGS. 9 and 10 are side and upper sectional views, respectively, of the trunnion 260. A set of two trunnions 260 may be threadedly or otherwise detachably connectable with the wristpin end 214 of the connecting rod 210 to pivotably connect the connecting rod 210 with the crosshead. One of the trunnions 260 may also be integrally formed with the connecting rod 210.

The trunnion 260 may comprise a cavity 266 extending axially through a portion of the trunnion 260. The trunnion 260 may comprise a circumferential outer surface 264 (e.g., an O-ring boss) configured to be inserted and closely fit within the smaller diameter bore portion 220 of the connecting rod 210. An O-ring (not shown) may be disposed around the circumferential outer surface 264 against the smaller diameter bore portion 220 to form a fluid seal therebetween. The trunnion 260 may comprise a circumferential outer surface 262 (e.g., a pilot boss) having an outer diameter that is greater than the diameter of the outer surface 264 and configured to be inserted and closely fit within the larger diameter bore portion 222 of the connecting rod 210. The trunnion 260 may comprise a circumferential outer surface 268 (e.g., a bushing seat) having an outer diameter 269 that is greater than the diameter of the outer surface 262 and configured to substantially match or otherwise support a corresponding ring portion 244 of the bushing 240 (shown in FIGS. 4 and 5). The circumferential outer surface 268 may directly or indirectly (e.g., via the bushing 240) pivotably engage or otherwise contact corresponding surfaces of the crosshead. A shoulder 270 may extend between the outer surfaces 262, 268. The shoulder 270 may be configured to abut or contact a side surface of the wristpin end 214 when the outer surface 262 is fully inserted into the larger diameter bore portion 222 of the wristpin end 214. Fasteners (e.g., threaded bolts) (not shown) may be inserted through bores 272 to connect the trunnion 260 to the connecting rod 210. The fasteners may extend through the bores 272 of one trunnion 260, the bores 226 of the connecting pin 210, and the bores 272 of the opposing trunnion 260 to thereby connect both trunnions 260 to the connecting rod 210. Radial bores 274 (e.g., pin holes) may extend radially through the trunnion 260 between the cavity 266 and the outer surface 268. The cavity 266 and the bores 274 may be configured to transfer a lubricant therethrough.

Figure 11:
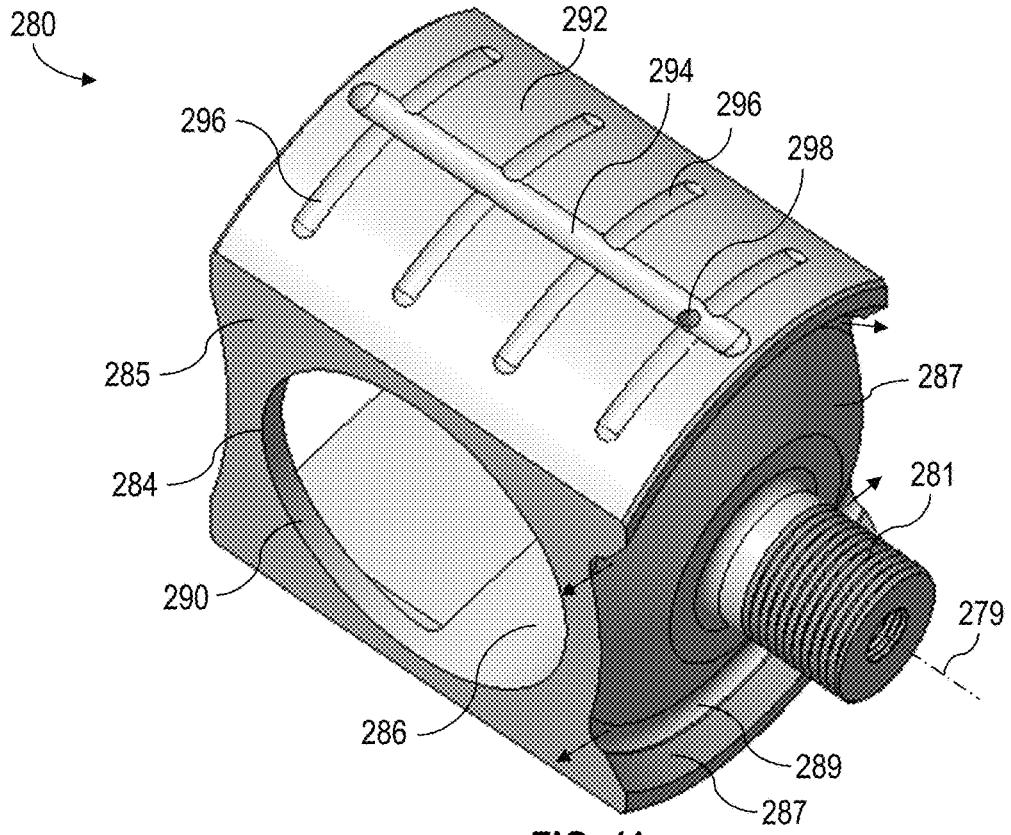
Figure 12:
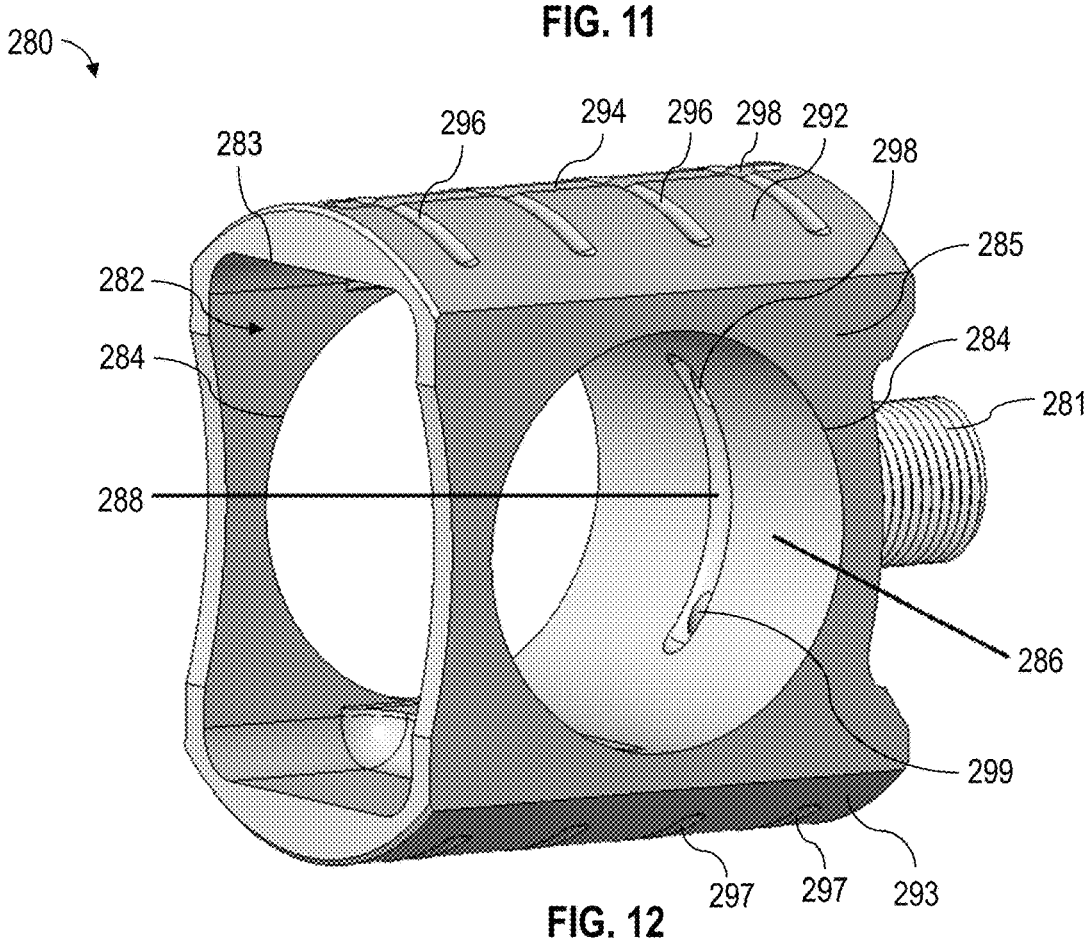
Figure 13:
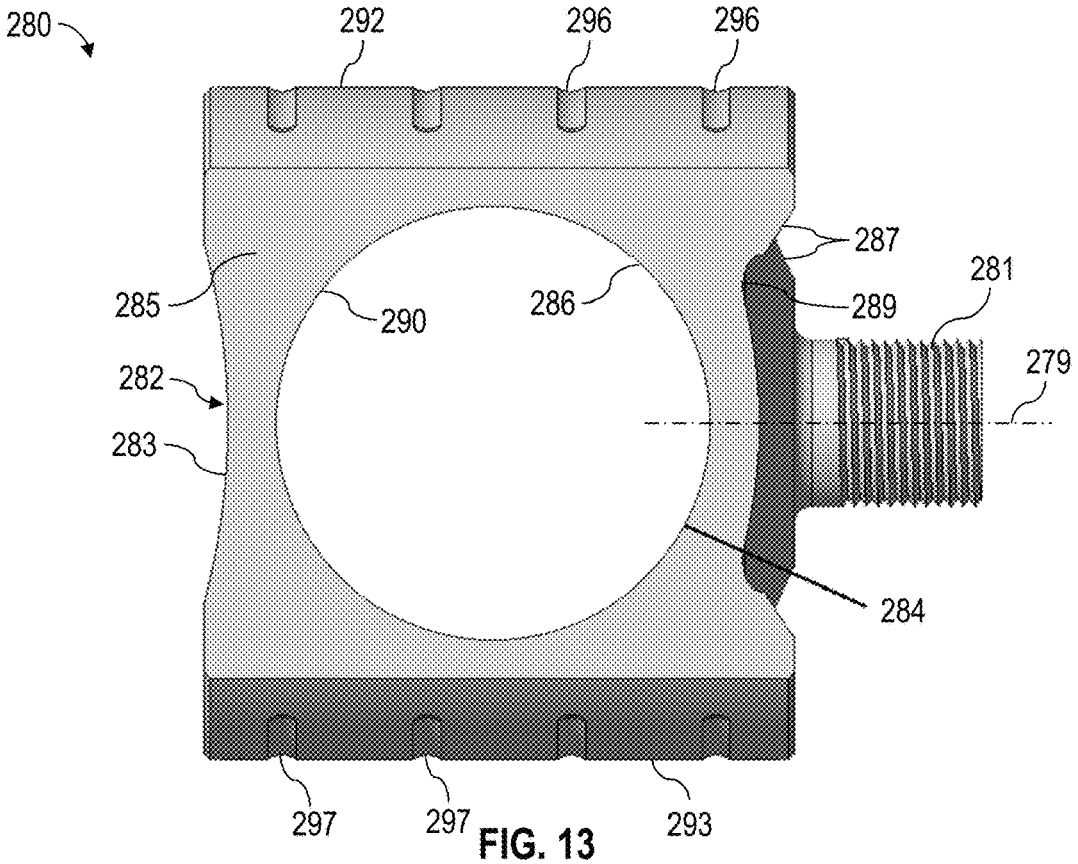
Figure 14:
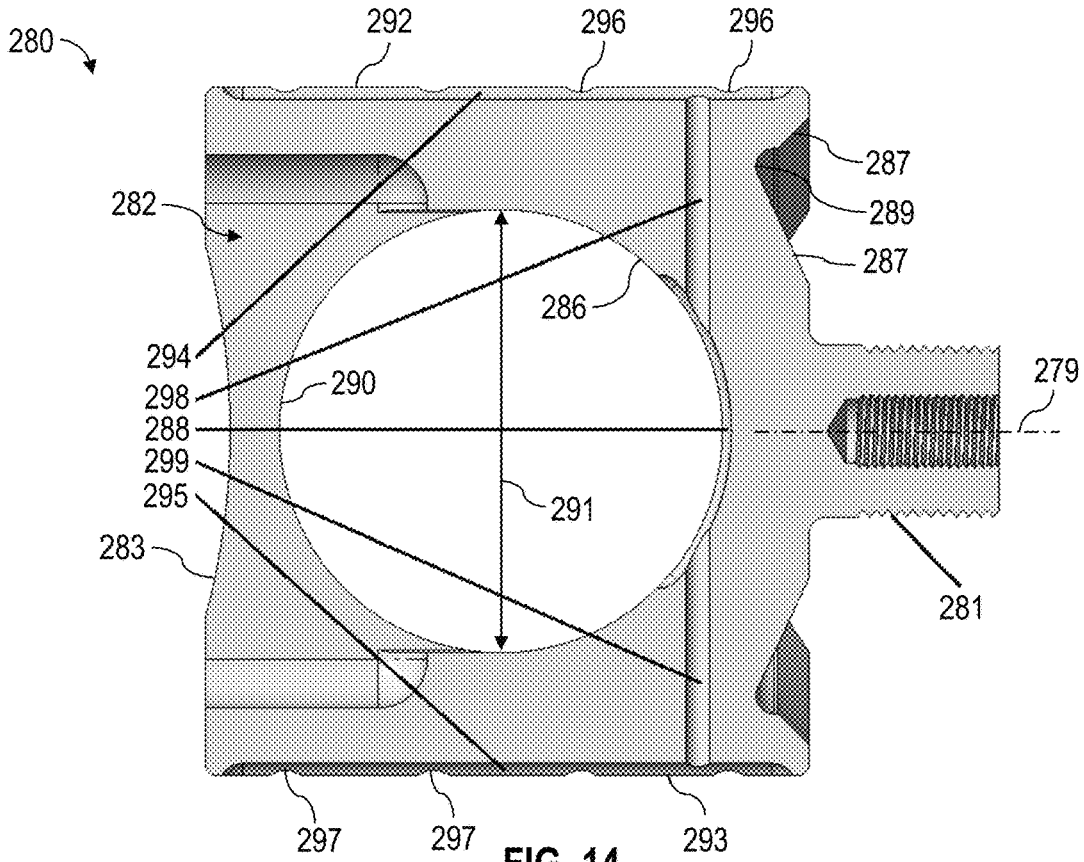

FIGS. 11 and 12 are perspective views of a crosshead 280 configured to be pivotably coupled with the wristpin end 214 of the connecting rod 210 shown in FIGS. 2 and 3. FIGS. 13 and 14 are side and side sectional views, respectively, of the crosshead 280.

The crosshead 280 may be a single-piece (i.e., unitary) member, which may be machined or otherwise made from a single piece of material (i.e., integrally formed) to comprise a plurality of features. The crosshead 280 may be a symmetric member. The crosshead 280 may comprise an internal cavity 282 having a central opening 283 configured to receive the wristpin end 214 of the connecting rod 210. The crosshead 280 may further comprise opposing side openings 284 extending into the internal cavity 282 through corresponding side surfaces 285 of the crosshead 280. The side openings 284 may be configured to receive a corresponding trunnion 260 shown in FIGS. 6-10. The crosshead 280 may further comprise a front inner curved surface 286 (e.g., a cylindric section surface) configured to directly or indirectly (e.g., via the bushing 240) pivotably engage or otherwise contact the wristpin end 214 of the connecting rod 210. The front inner curved surface 286 may engage or contact the front outer curved surface 250 of the bushing 240, shown in FIGS. 4 and 5, connected to the wristpin end 214. The front outer curved surface 250 closely fits the front inner curved surface 286 to distribute forces from the connecting rod 210 to the crosshead 280. A channel 288 extends circumferentially along a portion of the front inner curved surface 286. The crosshead 280 may further comprise rear inner curved surfaces 290 (e.g., cylindric section surfaces) each configured to abut or contact a corresponding rear outer curved surface 251 of the bushing 240. The front inner curved surface 286 and the front outer curved surface 250 may comprise an inner diameter 291 that is configured to closely fit with or otherwise accommodate the circumferential outer surface 268 of the trunnions 260. Thus, the inner diameter 291 of the front inner curved surface 286 and front outer curved surface 250 may be substantially equal to the outer diameter 269 of the outer surface 268 of the trunnions 260. The diameters 269, 291 may differ just by the thickness of the bushing 240.

The crosshead 280 may further comprise an upper outer surface 292 and a plurality of longitudinal and/or lateral channels 294, 296 extending along the upper surface 292. The lateral channels 296 may extend laterally with respect to the longitudinal channel 294. An upper bore 298 may extend between the longitudinal channel 294 (or another portion of the upper surface 292) and the circumferential channel 288. The crosshead 280 may further comprise a lower outer surface 293 and a plurality of longitudinal and/or lateral channels 295, 297 extending along the lower surface 293. The lateral channels 297 may extend laterally with respect to the longitudinal channel 295. A lower bore 299 may extend between the longitudinal channel 295 (or another portion of the lower surface 293) and the circumferential channel 288. The upper outer surface 292 and lower outer surface 293 may each be configured to slidably engage an inner surface of the crosshead support housing 144 of the pump 100. Friction pads (e.g., friction pads 330, 332 shown in FIG. 24) may define, cover, or otherwise be disposed against the inner surface of the crosshead support housing 144. The channels 288, 294, 295, 296, 297 may comprise semispherical cross-sections. The channels 288, 294, 295, 296, 297 and the bores 298, 299 may be or comprise fluid passages configured to transfer a lubricant.

The crosshead 280 may further comprise a fastener 281 (e.g., a threaded male connector) extending at an end of the crosshead 280 opposite the central opening 283. The fastener 281 may be coupled with a connecting rod (e.g., the connecting rod 146 shown in FIG. 1) configured to connect the crosshead 280 with a fluid-displacing member (e.g., the fluid-displacing member 116 shown in FIG. 1) of the pump. A front surface of the crosshead 280 may comprise opposing conical surfaces 287 extending diagonally with respect to a central axis 279 of the crosshead 280. The conical surfaces 287 may collectively comprise, form, or terminate with channels 289 that direct or otherwise permit lubricant to flow laterally out of the channels 289 to the sides of the crosshead 280, as indicated by arrows. The channels 289 thereby prevent or inhibit the lubricant from accumulating in front of the crosshead 280 while the crosshead 280 reciprocates during pumping operations.

Figure 15:
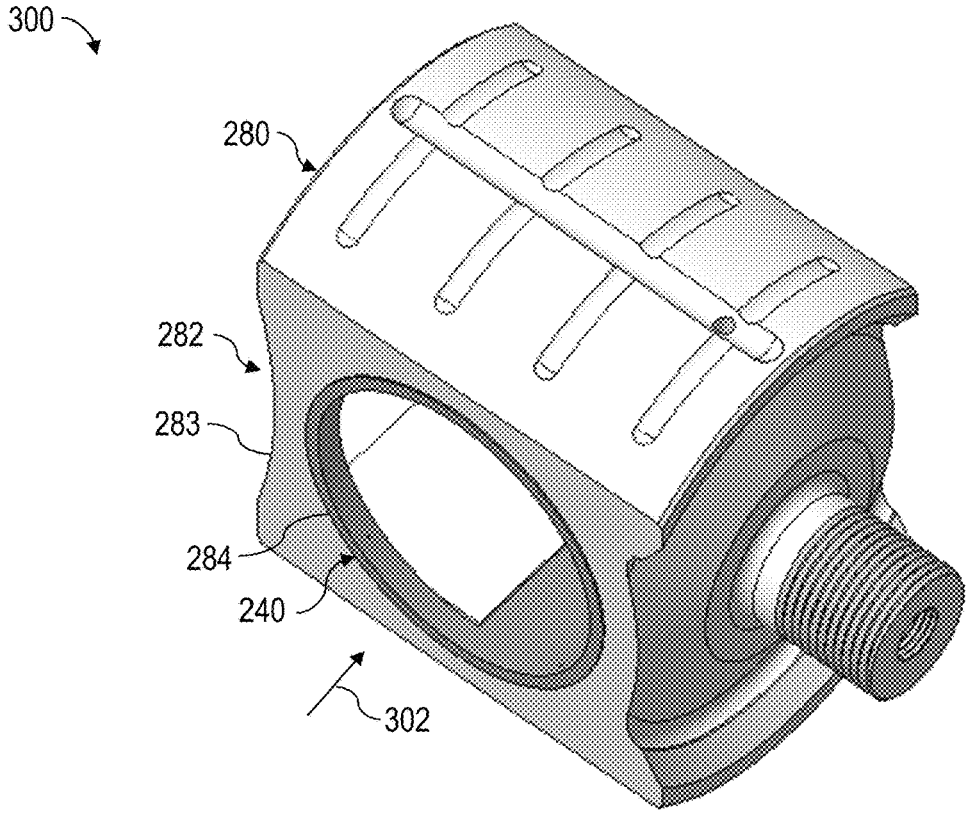

FIGS. 15-23 are various views of at least a portion of an example implementation of a crosshead assembly 300 according to one or more aspects of the present disclosure. FIG. 15 is a perspective view of the crosshead 280 with the bushing 240 inserted into the cavity 282 of the crosshead 280. The bushing 240 may be inserted into the cavity 282 via the opening 284, as indicated by arrow 302. The bushing 240 may be disposed within the cavity 280 to such that the front outer curved surface 250 of the bushing 240 is disposed against the front inner curved surface 286 of the crosshead 280 and the rear outer curved surfaces 251 of the bushing 240 are disposed against the rear inner curved surfaces 290 of the crosshead 280.

Figure 16:
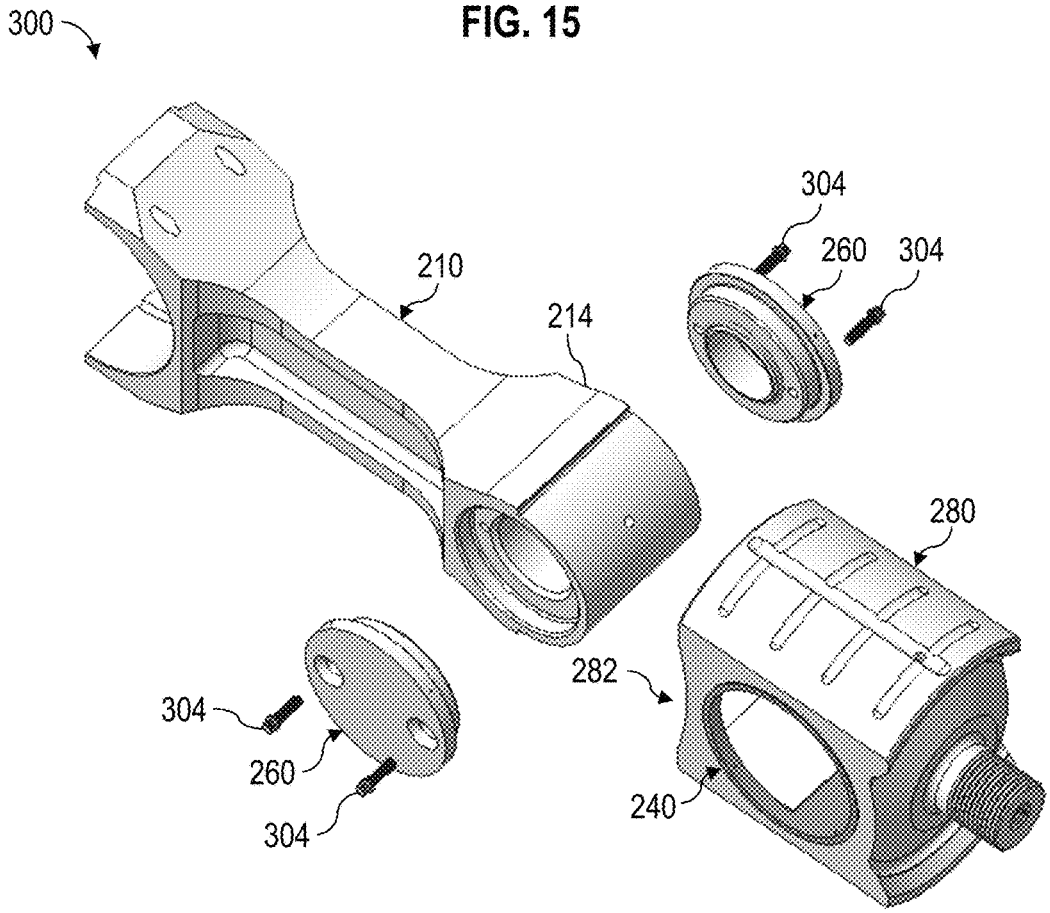
Figure 17:
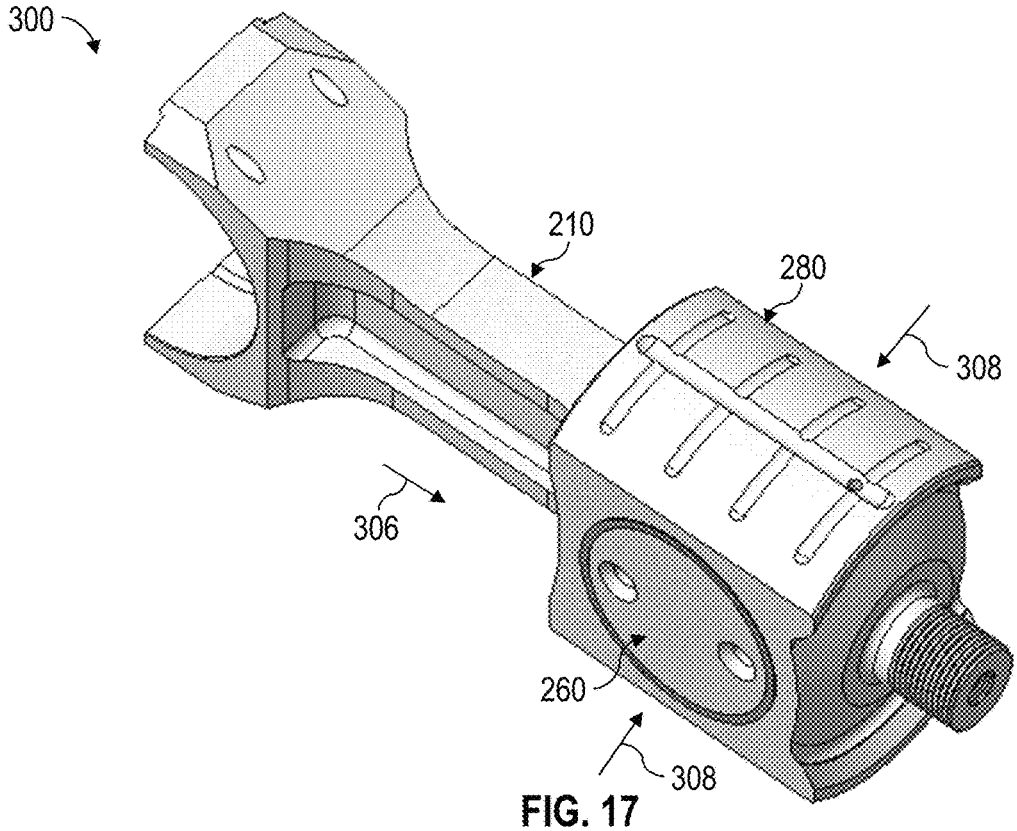
Figure 18:
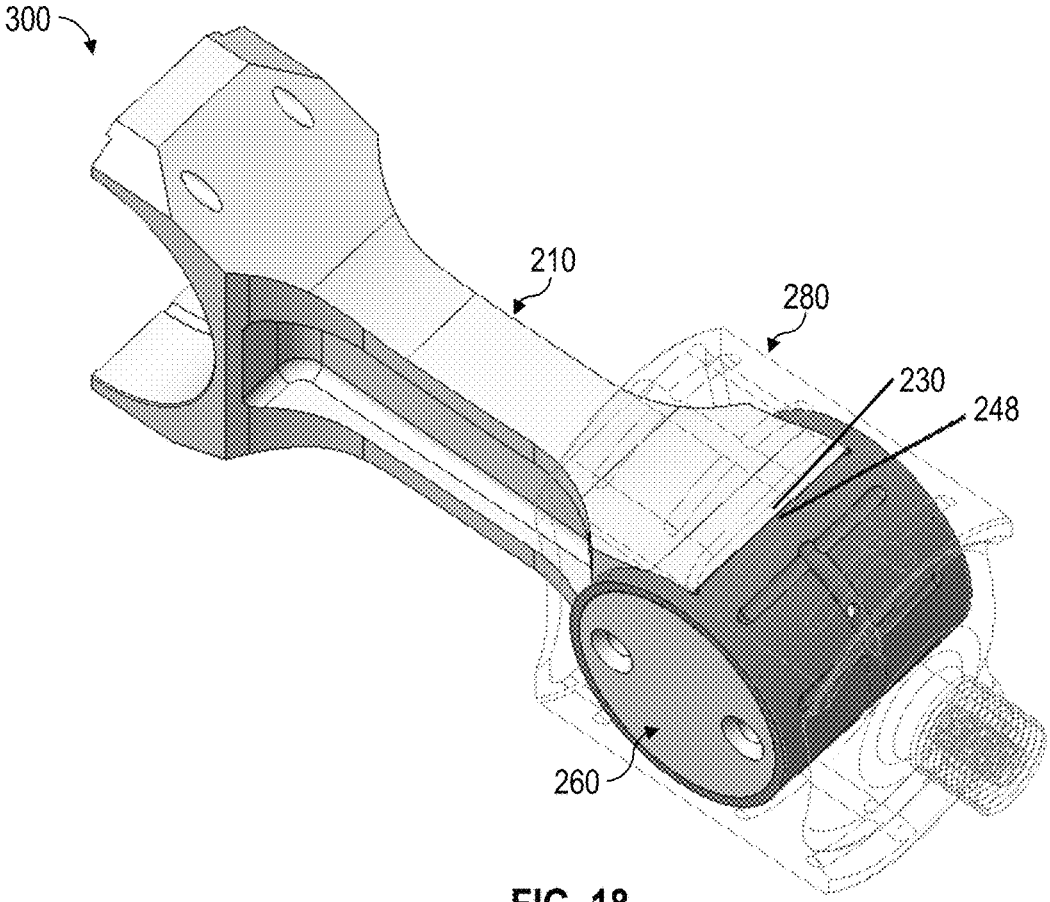

FIG. 16 is an exploded perspective view of at least a portion of the crosshead assembly 300. FIGS. 17 and 18 are each a perspective view of an assembled crosshead assembly 300. FIG. 16 shows the crosshead 280 containing the bushing 240 and the connecting rod 210 disposed adjacent the opening 283 of the cavity 282. FIG. 16 further shows the trunnions 260 and corresponding sets of bolts 304. FIGS. 17 and 18 show the wristpin end 214 inserted into the cavity 282 via the opening 383, as indicated by arrow 306, such that the outer surface 228 of the wristpin end 214 contacts the front inner curved surface 246 of the bushing 240. The trunnions 260 may be inserted into the bore 218 of the connecting rod 210 via the openings 284 of the crosshead 280, as indicated by arrows 308. In FIG. 18, the crosshead 280 is shown in phantom lines to facilitate an unobstructed view of portions of connecting rod 210 and the bushing 240. FIG. 18 shows the shoulders 248 of the bushing 240 disposed against corresponding shoulders 230 of the wristpin end 214, thereby preventing the bushing 240 from sliding (e.g., rotating, pivoting) about the outer surface 228 of the wristpin end 214, thereby maintaining alignment between the radial bores 256 of the bushing 240 and the radial bores 234 of the connecting rod 210. The trunnions 260 connected with the wristpin end 214 of the connecting rod 210 and the inner surfaces 286, 290 of the crosshead 280 may collectively form a wristpin joint pivotably connecting the connecting rod 210 with the crosshead 280.

Figure 19:
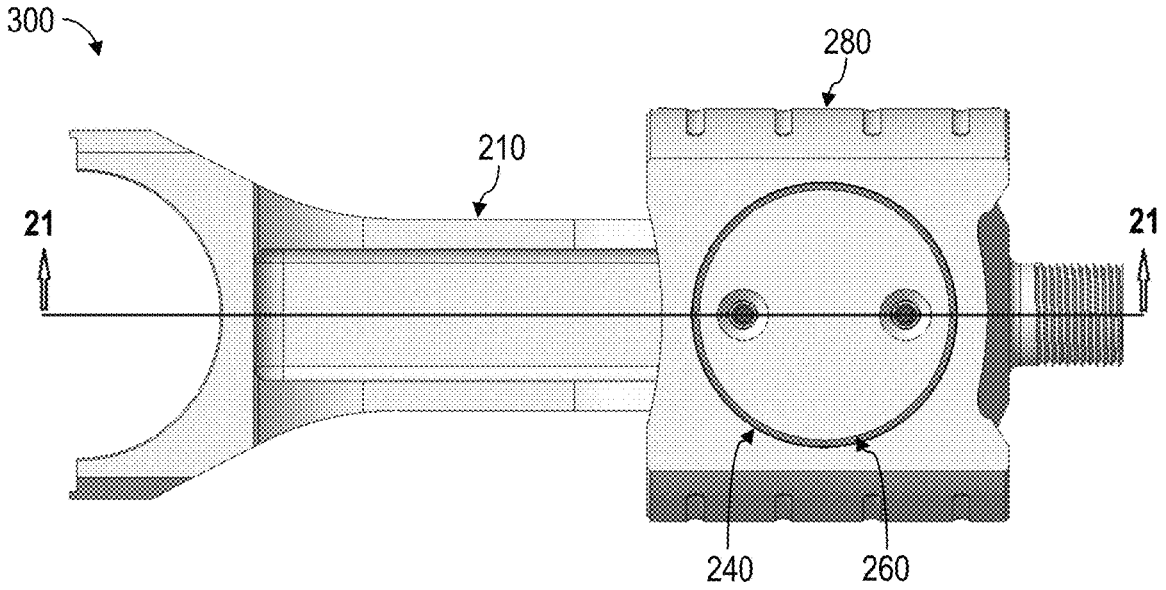
Figure 20:
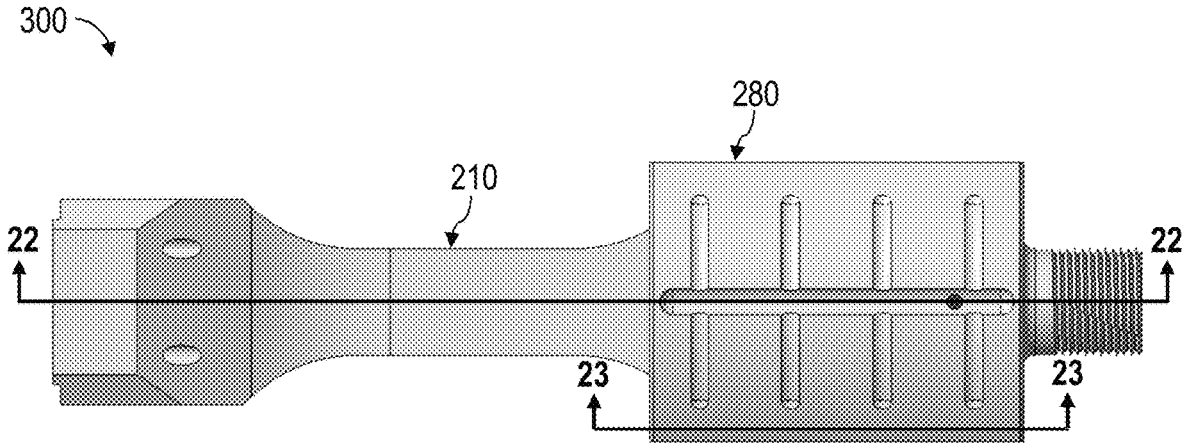
Figure 21:
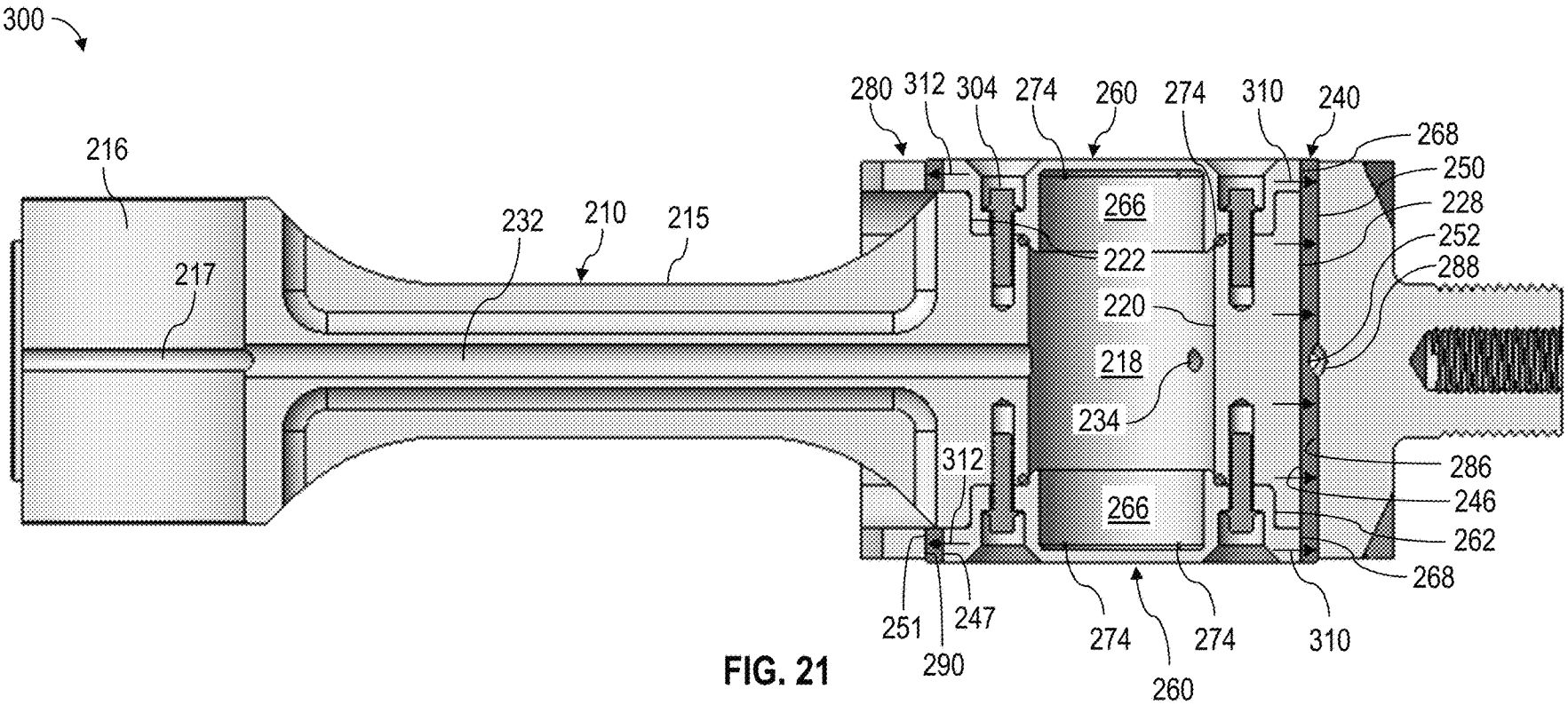

FIGS. 19 and 20 are side and top views, respectively, of at least a portion of the assembled crosshead assembly 300 according to one or more aspects of the present disclosure. FIG. 21 is a sectional upward view of the crosshead assembly 300 shown in FIG. 19. FIG. 21 shows the bushing 240 disposed within the crosshead 280 such that the front outer curved surface 250 of the bushing 240 is disposed against or in contact with the front inner curved surface 286 of the crosshead 280 and the rear outer curved surfaces 251 of the bushing 240 are disposed against or in contact with the rear inner curved surfaces 290 of the crosshead 280. Accordingly, the circumferential channel 288 of the crosshead 280 is at least partially aligned with and positioned against the circumferential channel 252 of the bushing 240 to collectively form a fluid pathway having a substantially oval (e.g., circular) cross-section having a flow area that is substantially equal to the flow area of the bores 298, 299 extending through the crosshead 280. FIG. 21 further shows the trunnions 260 disposed within the bore 218 of the connecting rod 210 and threadedly connected with the connecting rod 210 via bolts 304. The trunnions 260 fluidly seal, cover, or close the bore 218 on opposing sides, thereby forming a sealed fluid (i.e., lubricant) chamber comprising the bore 218 and the trunnion cavities 266. Fluid seals 274 may be disposed between the connecting rod 210 and the trunnions 260 to fluidly seal the fluid chamber 218, 266. The outer surfaces 268 of the trunnions 260 are shown disposed against or in contact with the front inner curved surface 246 and the rear inner curved surface 247 of the bushing 240. Thus, during pumping operations, namely during the forward (e.g., fluid-pressurizing phase) stroke of the connecting rod 210 and the crosshead 280, a relatively large force exerted by the connecting rod 210 against the crosshead 280, as indicated by arrows 310, is distributed along relatively large contact surface areas, including the front outer curved surface 250 of the bushing 240 and the front inner curved surface 286 of the crosshead 280. During pumping operations, namely during pull-back stroke of the connecting rod 210 and the crosshead 280, a relatively small force exerted by the connecting rod 210 against the crosshead 280, as indicated by arrows 312, is distributed along relatively small contact surface areas, including the rear outer curved surface 251 of the bushing 240 and the rear inner curved surface 290 of the crosshead 280.

The trunnions 260 connected to the connecting rod 210 act as extensions of the connecting rod 210 that engage the crosshead 280 and push it forward during the forward stroke and pull it back during the reverse stroke. The forward stroke involves relatively large loadings of thousands of pounds between the trunnions 260 and the crosshead 280 via the C-bushing portion 242 of the bushing 240. The crosshead assembly 300 may be rated to reliably support about 400,000 pounds or more of force exerted by the connecting rod 210 on the crosshead 280 during a forward stroke of the pumping operations. The reverse stroke involves relatively low loadings of a few hundred pounds between the trunnions 260 and the crosshead 280 via the ring bushing portions 244 of the bushing 240, which is why the trunnions 260 may not be heavily loaded during the reverse stroke. Furthermore, the trunnion outer surfaces 262 (plate male pilot bosses) are positively locked up against the close-fitting inner surface 222 (inner pilot bores) of the connecting rod 210 for effective load transfer, and the bolts hold the trunnions 260 to the connecting rod 210 without experiencing shear.

Figure 22:
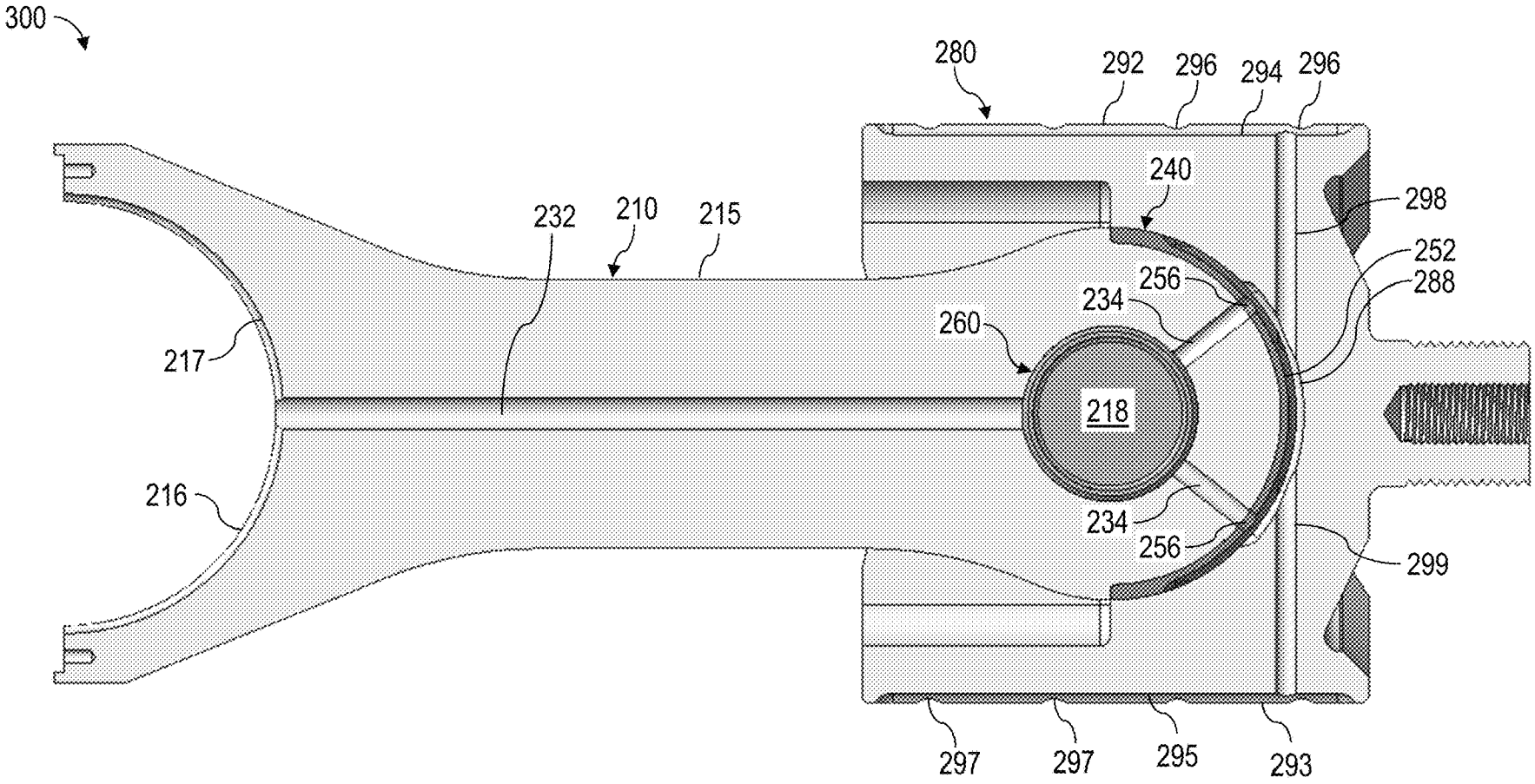

FIG. 22 is a sectional side view of the crosshead assembly 300 shown in FIG. 20. FIGS. 21 and 22 collectively show the bushing 240 disposed within the crosshead 280 such that the front outer curved surface 250 of the bushing 240 is disposed against or in contact with the front inner curved surface 286 of the crosshead 280. Accordingly, the circumferential channel 288 of the crosshead 280 is aligned with and positioned against the circumferential channel 252 of the bushing 240 to form a fluid passage having an oval cross-section. FIGS. 21 and 22 further collectively show a network of fluid channels extending between the upper and lower surfaces 292, 293 of the crosshead 280 and the inner circumferential surface 216 of the connecting rod 210, which may be utilized to transfer lubricant to various surfaces forming or otherwise connected with such fluid channels. The upper lateral channels 296 may be connected with the upper longitudinal channel 294, and the lower lateral channels 297 may be connected with the lower longitudinal channel 295. The upper bore 298 may be connected with the upper longitudinal channel 294 and with the fluid passage 252, 288. The lower bore 299 may be connected with the lower longitudinal channel 295 and with the fluid passage 252, 288. The fluid passage 252, 288 may connect the upper and lower bores 298, 299 with the radial bores 234, 256. The radial bores 234 may connect the fluid passage 252, 288 and with the bore 218 (i.e., the fluid chamber 218, 266), which may be enclosed by the opposing trunnions 260. The longitudinal bore 232 may extend between the bore 218 and the circumferential channel 217 extending along the inner circumferential surface 216. Thus, a lubricant may be transferred from the longitudinal channels 294, 295 to opposing sides of the bushing 240 to provide lubrication between the bushing 240 and the crosshead 280, and then to the surface 216 via the bores 234, 218, 232 and the circumferential channel 217 to provide lubrication between the surface 216 and the crankpin.

Figure 23:
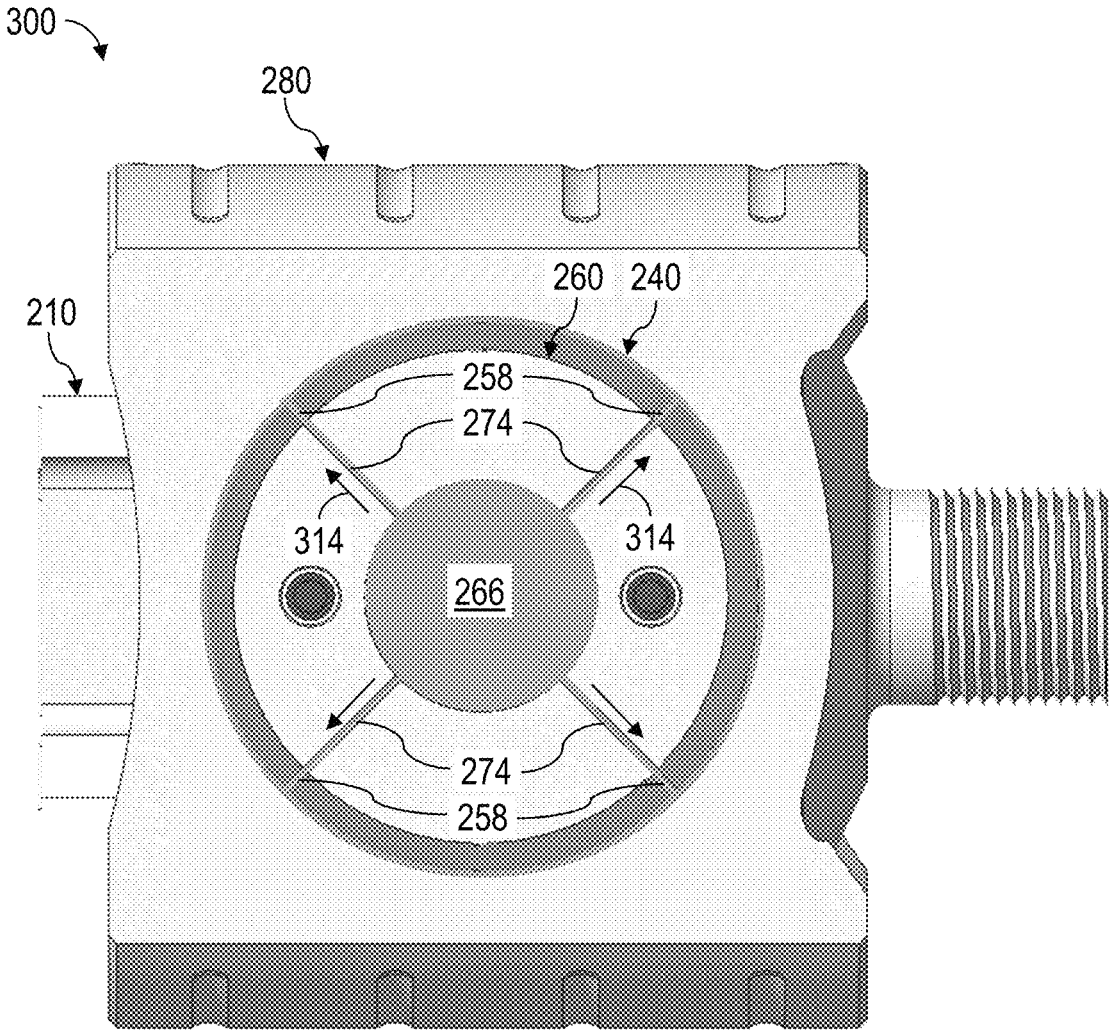

FIG. 23 is a sectional side view of a portion of the crosshead assembly 300 shown in FIG. 20. FIG. 23 shows one of the bushings 240 disposed between a corresponding trunnion 260 and the crosshead 280. FIG. 23 further shows a network of fluid pathways extending between the cavity 266 (i.e., the fluid chamber 218, 266) of the trunnion 260 and the inner surfaces 286, 290 of the crosshead 280, wherein such pathways may be utilized to transfer a lubricant to various surfaces forming or otherwise connected with such fluid pathways. The cavity 266 may be fluidly connected with the inner surfaces 246, 247 of the bushing 240 via a plurality of radial bores 274 extending through the trunnion 260. The cavity 266 may be fluidly connected with the outer surfaces 250, 251 of the bushing 240 via the radial bores 258, each aligned with a corresponding radial bore 274 and extending radially through the bushing 240. Thus, a lubricant may be transferred from the cavity 266 (connected with the bore 218) to opposing sides of the bushing 240, as indicated by arrows 314, to provide lubrication between the trunnion 260 and the crosshead 280.

Figure 24:
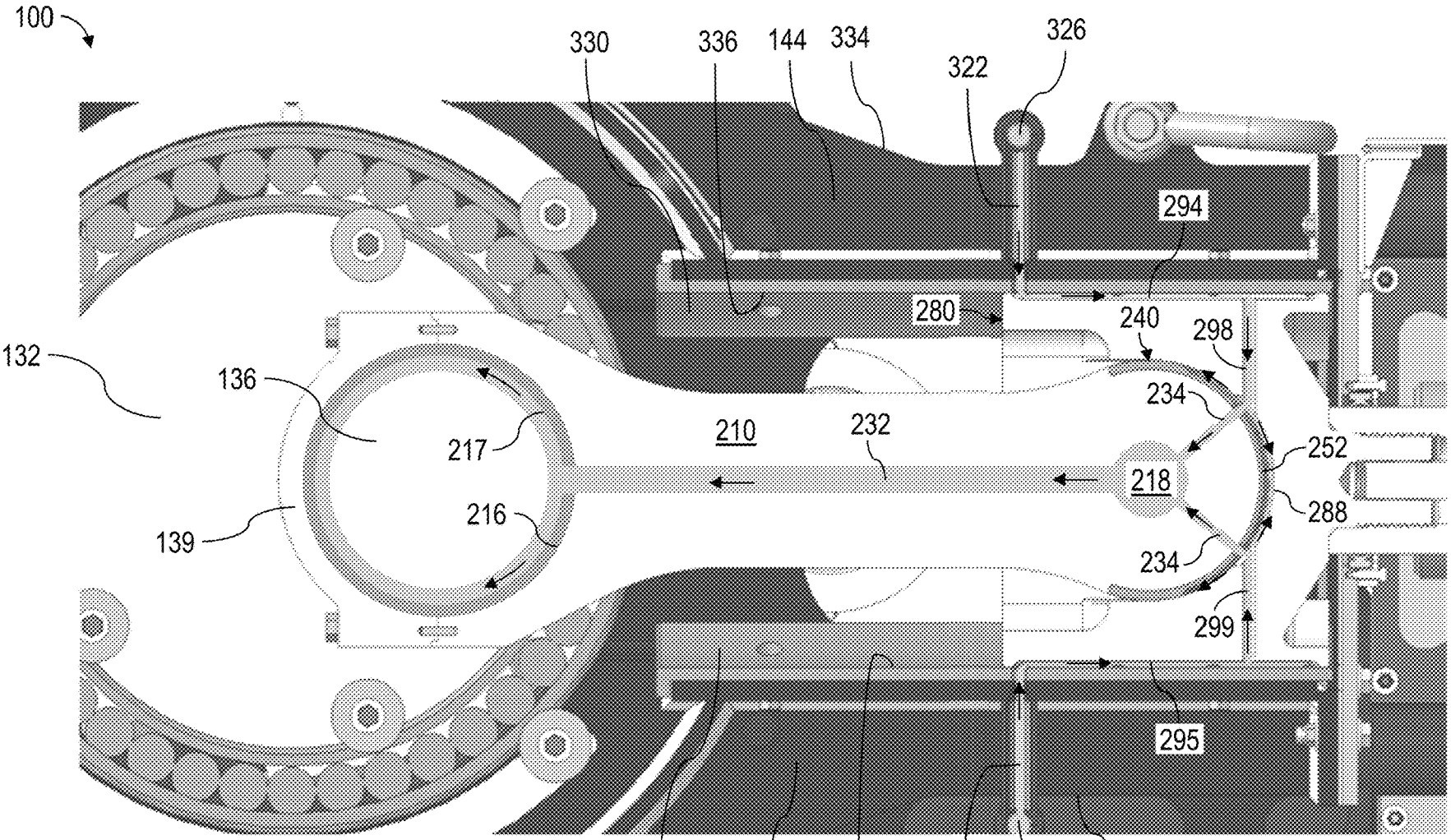
FIG. 24 is a sectional side view of the apparatus shown in FIG. 1 during example operations.

FIG. 24 is a sectional side view of a portion of the pump 100 shown in FIG. 1. FIG. 24 shows a network of fluid pathways extending from a fluid source external to the pump 100 to various portions and surfaces of the crosshead assembly 300. Such fluid pathways may be utilized to transfer lubricant from a lubricant source to the crosshead assembly 300 during pumping operations. The lubricant may be introduced into the pump 100 via ports 322, 324 having inlets 326, 328 external to the crosshead support housing 144. Each port 322, 324 may extend through the crosshead support housing 144 between an outer surface 334 and an inner surface 336 of the crosshead support housing 144 on opposing upper and lower sides of the pump 100. Each inner surface 336 of the crosshead support housing 144 may be defined or covered by a corresponding upper and lower friction pad 330, 332. Each port 322, 324 may extend through the crosshead support housing 144 (including corresponding upper and lower friction pads 330, 332) and connect with a corresponding longitudinal channel 294, 295 of the crosshead 280. A lubricant may be introduced via the inlets 326, 328, flow through the ports 322, 324, and enter the longitudinal channels 294, 295, as indicated by the arrows. Although the crosshead 280 reciprocates during pumping operations, the ports 322, 324 are constantly fluidly connected with (or along) a portion of the longitudinal channels 294, 295. The lubricant may then flow along the longitudinal channels 294, 295 into the upper and lower bores 298, 299 and into the circumferential channels 252, 288 to introduce the lubricant between the crosshead 280 and the bushing 240. The lubricant may then flow through the radial bores 234 into the bore 218 of the wristpin end 214 and through the longitudinal bore 232 of the connecting rod 210 until the lubricant reaches the longitudinal channel 217 along the inner curved surface 216 of the connecting rod 210, as indicated by the arrows. The lubricant may then flow between the crankpin 136 and the inner surface 216 of the connecting rod 210 and an inner surface of the rod clamp 139.

Figure 25:
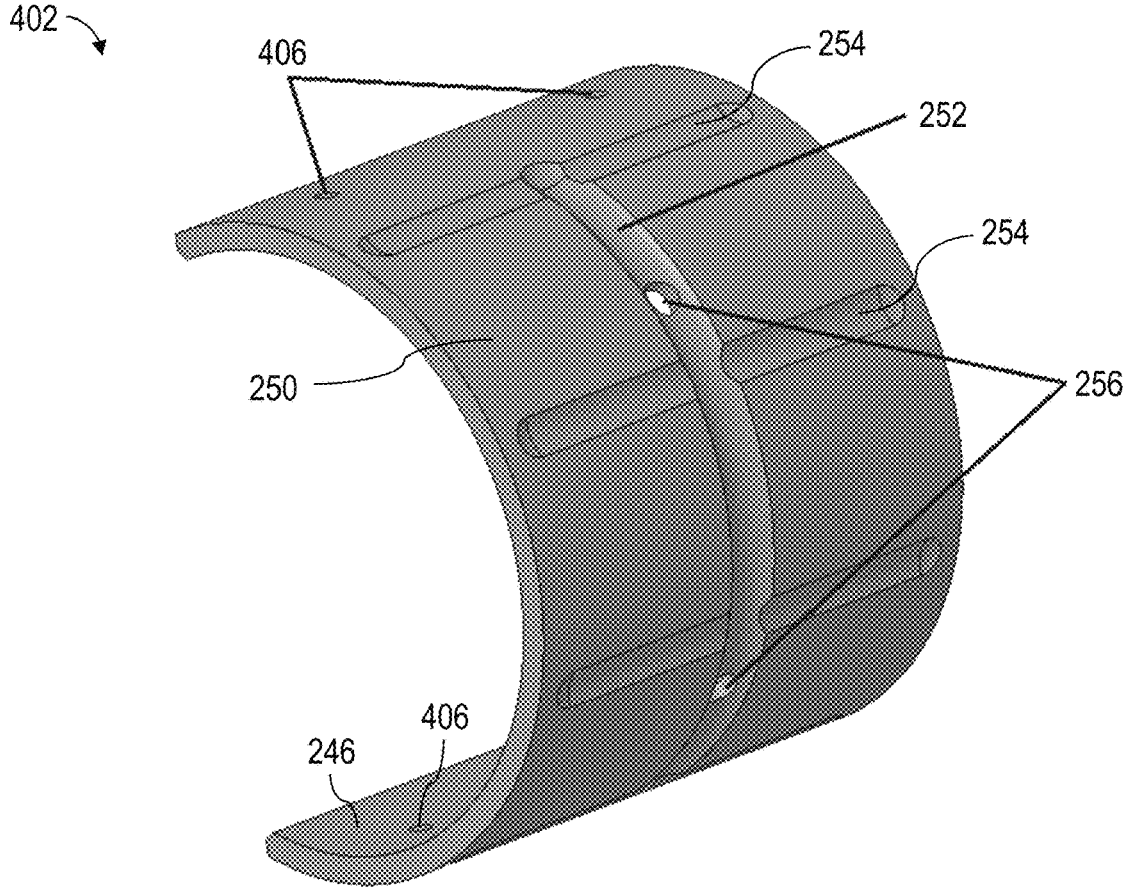
FIGS. 25-28 are views of various portion of the apparatus shown in FIG. 1 according to one or more aspects of the present disclosure.
Figure 26:
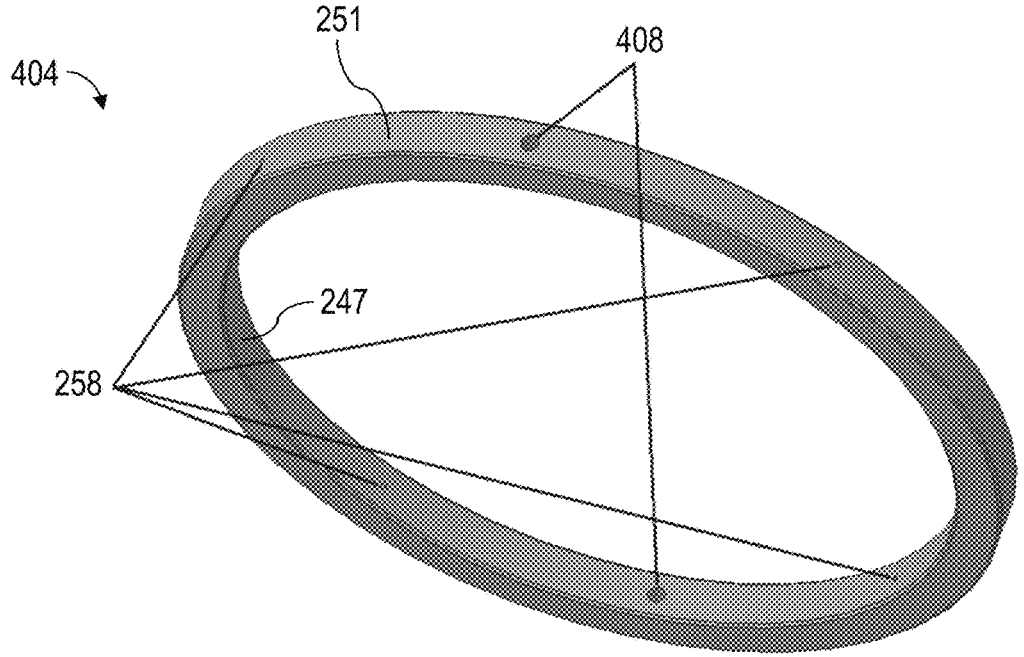

FIGS. 25 and 26 show perspective views of opposing sides of a C-bushing 402 and a ring bushing 404, respectively, which may be utilized as part of a crosshead assembly instead of the bushing 240 shown in FIGS. 4 and 5. The C-bushing 402 may comprise one or more features of the C-bushing portion 242 of the bushing 240, and the ring bushing 404 may comprise one or more features of the ring bushing portion 244 of the bushing 240, as indicated by the same reference numerals.

The C-bushing 402 may further comprise a plurality of openings 406 configured to receive spring roll pins or other fasteners, which may be utilized to fasten the C-bushing 402 about the outer curved surface 228 of the wristpin end 214. The ring bushing 404 may comprise a plurality of openings 408 configured to receive spring roll pins or other fasteners, which may be utilized to fasten the ring bushing 404 about the circumferential outer surface 262 of the corresponding trunnion 260.

Figure 27:
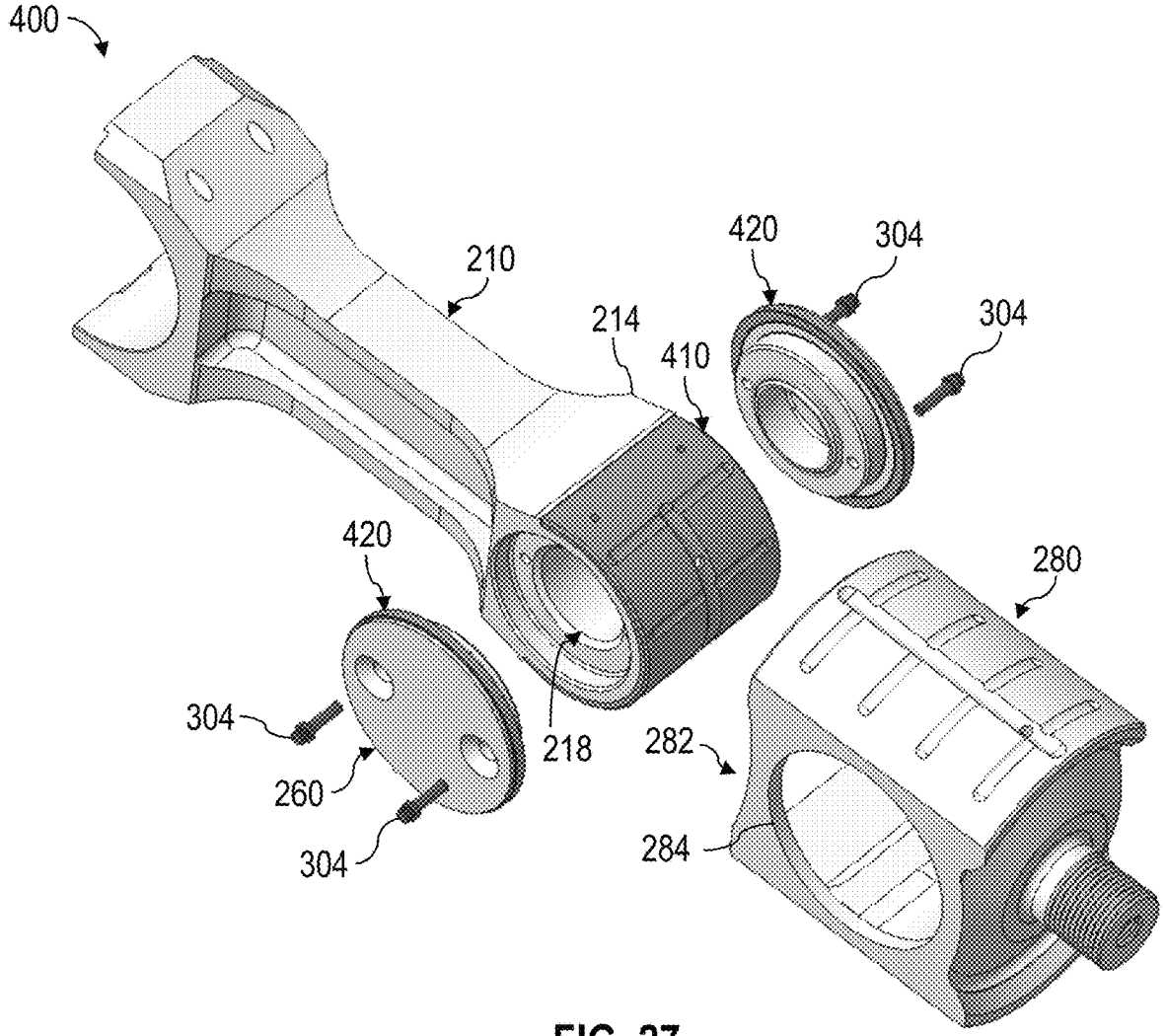

FIG. 27 shows an exploded perspective view of at least a portion of a crosshead assembly 400 with the C-bushing 402 connected with the wristpin end 214 of the connecting rod 210 and the ring bushings 404 connected with the trunnions 260. The crosshead assembly 400 may comprise one or more features of the crosshead assembly 300, including where indicated by the same reference numerals. The connecting rod 210 with the C-bushing 410 may be inserted into the cavity 282 of the crosshead 280, and the trunnions 260 with the ring bushings 420 may then be inserted into the bore 218 of the connecting rod 210 via side openings 284 of the crosshead 280.

Figure 28:
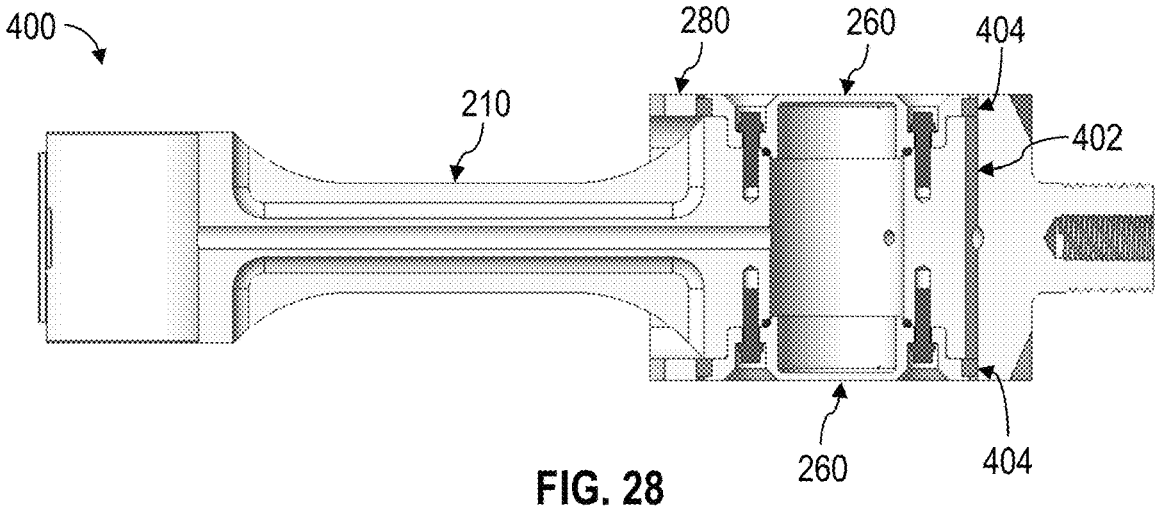

FIG. 28 is a sectional upward view of the crosshead assembly 400 utilizing the C-bushing 402 and the ring bushing 404. The C-bushing 402 is disposed between the crosshead 280 and the connecting rod 210, and each ring bushing 404 is disposed between the crosshead 280 and a corresponding trunnion 260.

In view of the entirety of the present disclosure, including the figures and the claims, a person having ordinary skill in the art will readily recognize that the present disclosure introduces an apparatus comprising a crosshead assembly for a reciprocating pump, wherein the crosshead assembly comprises: a crosshead; a connecting rod configured to connect with a crankshaft of the reciprocating pump; and trunnions detachably connected with the connecting rod and facilitating pivotable connection of the connecting rod and the crosshead.

The trunnions may pivotably engage at least a portion of the crosshead to pivotably connect the connecting rod with the crosshead.

The connecting rod may comprise a first surface at a first end of the connecting rod and a second surface at a second end of the connecting rod, and a fluid passage may extend through the connecting rod between the first and second surfaces. The first end of the connecting rod may pivotably engage the crosshead, and the fluid passage may comprise: a first bore extending through the first end perpendicularly with respect to the connecting rod; a second bore extending between the first bore and the first surface; and a third bore extending between the first bore and the second surface.

A first end of the connecting rod may comprise an outer surface, the first end may pivotably engage the crosshead, and a fluid passage extending through the connecting rod may comprise: a first bore extending through the first end perpendicularly with respect to the connecting rod; and a second bore extending between the first bore and the outer surface. The trunnions may pivotably engage at least a portion of the crosshead to pivotably connect the connecting rod with the crosshead. Each trunnion may close an opposing side of the first bore to form a fluid chamber. Each trunnion may comprise a plurality of third bores extending between the fluid chamber and an outer surface of each trunnion. The crosshead assembly may comprise a bushing comprising a C-bushing portion and two ring bushing portions. The C-bushing portion may be disposed between the outer surface of the connecting rod and an inner surface of the crosshead. Each ring bushing portion may be disposed between the inner surface of the crosshead and an outer surface of a corresponding trunnion. The bushing may comprise a plurality of third bores extending between an inner surface of the bushing and an outer surface of the bushing.

Each trunnion may comprise an outer curved surface pivotably engaging the crosshead, the crosshead may comprise an inner curved surface pivotably engaging an end of the connecting rod, and the inner curved surface and the outer curved surface may comprise substantially equal diameters.

The crosshead may be an integrally-formed, single-piece member.

The crosshead may comprise: an inner curved surface engaging an end of the connecting rod; and a front surface opposite the inner curved surface, wherein the front surface may comprise a channel to direct flow of lubricant from the front surface to a side of the crosshead while the crosshead reciprocates during pumping operations. The front surface may extend diagonally with respect to a longitudinal axis of the connecting rod.

The connecting rod may comprise a first surface at a first end of the connecting rod and a second surface at a second end of the connecting rod, a first fluid passage may extend through the connecting rod between the first and second surfaces, a second fluid passage may extend through the crosshead, and the first and second fluid passages may be connected. The crosshead may comprise: an outer surface slidably engaging a housing of the reciprocating pump; and an inner surface engaging an end of the connecting rod, wherein the second fluid passage may extend between the inner surface and the outer surface of the crosshead. The crosshead assembly may comprise a bushing between an end of the connecting rod and an inner surface of the crosshead, the bushing may comprise a plurality of bores extending between an inner surface of the bushing and an outer surface of the bushing, and the bores may fluidly connect the first fluid passage and the second fluid passage. The bushing may comprise a first channel extending along the outer surface of the bushing, the first channel may be connected with the bores, the crosshead may comprise a second channel extending along the inner surface of the crosshead, the second channel may be connected with the second fluid passage, and the first channel and second channel may be at least partially aligned to collectively form a third fluid passage fluidly connecting the bores and the second fluid passage. The third fluid passage may comprise a substantially oval cross-section. The outer surface of the bushing may be curved, the inner surface of the crosshead may be curved, the first channel may extend circumferentially along the outer surface of the bushing, and the second channel may extend circumferentially along the inner surface of the crosshead.

The present disclosure also introduces an apparatus comprising a crosshead assembly for a reciprocating pump, wherein the crosshead assembly comprises: a crosshead; and a connecting rod pivotably connected with the crosshead and configured to connect with a crankshaft of the reciprocating pump, wherein the connecting rod comprises a fluid passage extending through the connecting rod.

The crosshead assembly may be configured to operatively connect the crankshaft of the reciprocating pump and a fluid-displacing member of the reciprocating pump.

The connecting rod may comprise a first surface at a first end of the connecting rod and a second surface at a second end of the connecting rod, and the fluid passage may extend through the connecting rod between the first and second surfaces. The first end of the connecting rod may pivotably engage the crosshead, and the fluid passage may comprise: a first bore extending through the first end of the connecting rod perpendicularly with respect to the connecting rod; a second bore extending between the first bore and the first surface; and a third bore extending between the first bore and the second surface.

The connecting rod may comprise an outer surface at a first end of the connecting rod, the first end of the connecting rod may pivotably engage the crosshead, and the fluid passage may comprise: a first bore extending through the first end of the connecting rod perpendicularly with respect to the connecting rod; and a second bore extending between the first bore and the outer surface of the connecting rod. The crosshead assembly may comprise trunnions connected at the first end of the connecting rod. The trunnions may pivotably engage at least a portion of the crosshead to pivotably connect the connecting rod with the crosshead. Each trunnion may close an opposing side of the first bore to form a fluid chamber. Each trunnion may comprise a plurality of third bores extending between the fluid chamber and an outer surface of each trunnion. The crosshead assembly may comprise a bushing comprising a C-bushing portion and two ring bushing portions, wherein the C-bushing portion is disposed between the outer surface of the connecting rod and an inner surface of the crosshead, and wherein each ring bushing portion is disposed between the inner surface of the crosshead and an outer surface of a corresponding trunnion. The bushing may comprise a plurality of third bores extending between an inner surface of the bushing and an outer surface of the bushing.

The crosshead assembly may comprise trunnions pivotably connecting the connecting rod with the crosshead. Each trunnion may comprise an outer curved surface pivotably engaging the crosshead. The crosshead may comprise an inner curved surface pivotably engaging an end of the connecting rod. The inner curved surface and the outer curved surface may comprise substantially equal diameters. The trunnions may be detachably connected with the end of the connecting rod.

The crosshead may be an integrally-formed, single-piece member.

The crosshead may comprise: an inner curved surface engaging an end of the connecting rod; and a front surface opposite the inner curved surface. The front surface may comprise a channel configured to direct flow of lubricant from the front surface to a side of the crosshead while the crosshead reciprocates during pumping operations. The front surface may extend diagonally with respect to a longitudinal axis of the connecting rod.

The fluid passage may be a first fluid passage, the crosshead may comprise a second fluid passage extending through the crosshead, and the first fluid passage and the second fluid passage may be connected. In such implementations, among others within the scope of the present disclosure, the crosshead may comprise: an outer surface configured to slidably engage a housing of the reciprocating pump; and an inner surface engaging an end of the connecting rod, wherein the second fluid passage extends between the inner surface and the outer surface of the crosshead. The crosshead assembly may comprise a bushing between an end of the connecting rod and an inner surface of the crosshead, the bushing may comprise a plurality of bores extending between an inner surface of the bushing and an outer surface of the bushing, and the bores may fluidly connect the first fluid passage and the second fluid passage. The bushing may comprise a first channel extending along the outer surface of the bushing, the first channel may be connected with the bores, the crosshead may comprise a second channel extending along the inner surface of the crosshead, the second channel may be connected with the second fluid passage, and the first channel and the second channel may be at least partially aligned to collectively form a third fluid passage fluidly connecting the bores and the second fluid passage. The third fluid passage may comprise a substantially oval cross-section. The outer surface of the bushing may be curved, the inner surface of the crosshead may be curved, the first channel may extend circumferentially along the outer surface of the bushing, and the second channel may extend circumferentially along the inner surface of the crosshead. The bushing may comprise a plurality of third channels extending along the outer surface of the bushing, each of the third channels may be connected with the first channel and extend laterally with respect to the first channel, the crosshead may comprise a plurality of fourth channels extending along the inner surface of the crosshead, and each of the fourth channels may be connected with the second channel and extend laterally with respect to the second channel.

The present disclosure also introduces an apparatus comprising a crosshead assembly for a reciprocating pump, wherein the crosshead assembly comprises: (A) a crosshead configured to be slidably disposed within a housing of the reciprocating pump, wherein the crosshead comprises: (1) a first crosshead surface configured to slidably engage the housing; (2) a second crosshead surface; and (3) a first fluid passage extending between the first crosshead surface and second crosshead surface; and (B) a connecting rod configured to operatively connect a crankshaft of the reciprocating pump with the crosshead, wherein the connecting rod comprises: (1) a first connecting rod surface pivotably engaging the first crosshead surface; (2) a second connecting rod surface configured to pivotably engage the crankshaft; and (3) a second fluid passage extending between the first connecting rod surface and second connecting rod surface, wherein the first fluid passage and the second fluid passage are connected and configured to transfer a lubricant.

The present disclosure also introduces an apparatus comprising a reciprocating pump comprising: (A) a housing comprising: (1) an outer housing surface; (2) an inner housing surface; and (3) a fluid port extending between the outer housing surface and the inner housing surface; (B) a crankshaft; and (C) a crosshead assembly comprising: (1) a crosshead slidably disposed within the housing, wherein the crosshead comprises: (i) a first crosshead surface configured to slidably engage the inner housing surface during pumping operations; (ii) a second crosshead surface; and (iii) a first fluid passage extending between the first crosshead surface and the second crosshead surface, wherein the fluid port and the first fluid passage are fluidly connected during pumping operations; and (2) a connecting rod operatively connecting the crankshaft with the crosshead, wherein the connecting rod comprises: (i) a first connecting rod surface pivotably engaging the first crosshead surface; (ii) a second connecting rod surface pivotably engaging the crankshaft; and (iii) a second fluid passage extending between the first connecting rod surface and the second connecting rod surface, wherein the first fluid passage and the second fluid passage are fluidly connected, and wherein the fluid port, the first fluid passage, and the second fluid passage are configured to transfer a lubricant.

The foregoing outlines various features so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the implementations introduced herein. A person having ordinary skill in the art should also realize that such equivalent constructions do not depart from the scope of the present disclosure, and that they may make various changes, substitutions, and alterations herein without departing from the spirit and scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. An apparatus comprising a crosshead assembly for a reciprocating pump, wherein the crosshead assembly comprises:

a unitary crosshead with cylindrical side openings and a first channel extending along an inner surface of the unitary crosshead;

a connecting rod configured to connect with a crankshaft of the reciprocating pump, wherein the connecting rod comprises a first surface at a first end of the connecting rod and a second surface at a second end of the connecting rod, wherein a first fluid passage extends through the connecting rod between the first and second surfaces and a second fluid passage extends through the unitary crosshead, and wherein the first and second fluid passages are connected;

trunnions having circumferential outer surfaces fittingly accommodated within the cylindrical side openings and detachably connected with the connecting rod to facilitate pivotable connection of the connecting rod and the unitary crosshead to distribute forces from the connecting rod to the unitary crosshead during the reciprocating; and a bushing between an end of the connecting rod and the inner surface of the unitary crosshead, wherein the bushing comprises:

a plurality of bores extending between an inner surface of the bushing and an outer surface of the bushing, wherein the plurality of bores fluidly connect the first fluid passage and the second fluid passage; and a second channel connected with the plurality of bores and extending along the outer surface of the bushing, wherein the second channel is connected with the second fluid passage, and wherein the first channel and the second channel are at least partially aligned to collectively form a third fluid passage fluidly connecting the plurality of bores and the second fluid passage.

2. The apparatus of claim 1 wherein the trunnions pivotably engage at least a portion of the unitary crosshead to pivotably connect the connecting rod with the unitary crosshead.

3. The apparatus of claim 1 wherein the first end of the connecting rod pivotably engages the unitary crosshead, and wherein the first fluid passage comprises:

a first bore extending through the first end perpendicularly with respect to the connecting rod;

a second bore extending between the first bore and the first surface; and a third bore extending between the first bore and the second surface.

4. The apparatus of claim 1 wherein:

the first end of the connecting rod comprises an outer surface;

the first end pivotably engages the unitary crosshead;

the first fluid passage extending through the connecting rod comprises:

a first bore extending through the first end perpendicularly with respect to the connecting rod; and a second bore extending between the first bore and the outer surface of the connecting rod;

the trunnions pivotably engage at least a portion of the unitary crosshead to pivotably connect the connecting rod with the unitary crosshead; and each trunnion closes an opposing side of the first bore to form a fluid chamber.

5. The apparatus of claim 4 wherein each trunnion comprises a plurality of third bores extending between the fluid chamber and an outer surface of each trunnion.

6. The apparatus of claim 4 wherein the bushing comprises a C-bushing portion and two ring bushing portions, wherein the C-bushing portion is disposed between the outer surface of the connecting rod and the inner surface of the unitary crosshead, and wherein each ring bushing portion is disposed between the inner surface of the unitary crosshead and a circumferential outer surface of a corresponding trunnion.

7. The apparatus of claim 6 wherein the bushing comprises a plurality of third bores extending between the inner surface of the bushing and the outer surface of the bushing.

8. The apparatus of claim 1 wherein:

each trunnion comprises an outer curved surface pivotably engaging the unitary crosshead;

the unitary crosshead comprises an inner curved surface pivotably engaging an end of the connecting rod;

the inner curved surface and the outer curved surface comprise substantially equal diameters.

9. The apparatus of claim 1 wherein the unitary crosshead is an integrally-formed, single-piece member.

10. The apparatus of claim 1 wherein the unitary crosshead comprises:

an inner curved surface engaging an end of the connecting rod; and a front surface opposite the inner curved surface, wherein the front surface comprises a channel to direct flow of lubricant from the front surface to a side of the unitary crosshead while the unitary crosshead reciprocates during pumping operations.

11. The apparatus of claim 10 wherein the front surface extends diagonally with respect to a longitudinal axis of the connecting rod.

12. The apparatus of claim 1 wherein the unitary crosshead further comprises:

an outer surface slidably engaging a housing of the reciprocating pump; and the inner surface engaging an end of the connecting rod, wherein the second fluid passage extends between the inner surface and the outer surface of the unitary crosshead.

13. The apparatus of claim 1 wherein the third fluid passage comprises a substantially oval cross-section.

14. The apparatus of claim 1 wherein:

the outer surface of the bushing is curved;

the inner surface of the unitary crosshead is curved;

the second channel extends circumferentially along the outer surface of the bushing; and the first channel extends circumferentially along the inner surface of the unitary crosshead.

15. An apparatus comprising:

a crosshead assembly for a reciprocating pump, wherein the crosshead assembly comprises:

a unitary crosshead with cylindrical side openings slidably disposed within a housing of the reciprocating pump and comprising:

a first crosshead surface slidably engaging the housing;

a second crosshead surface; and a first fluid passage extending between the first and second crosshead surfaces; and a connecting rod operatively connecting a crankshaft of the reciprocating pump with the unitary crosshead via trunnions having circumferential outer surfaces fittingly accommodated within the cylindrical side openings to distribute forces from the connecting rod to the unitary crosshead during the reciprocating, the connecting rod comprising:

a first connecting rod surface pivotably engaging the first crosshead surface;

a second connecting rod surface pivotably engaging the crankshaft; and a second fluid passage extending between the first and second connecting rod surfaces, wherein the first and second fluid passages are connected and transfer a lubricant.

16. The apparatus of claim 15 wherein the trunnions pivotably engage at least a portion of the unitary crosshead to pivotably connect the connecting rod with the unitary crosshead.

17. The apparatus of claim 15 wherein the unitary crosshead is an integrally-formed, single-piece member.

18. An apparatus comprising:

a reciprocating pump comprising:

a housing comprising:

an inner housing surface;

an outer housing surface;

a fluid port extending between the inner and outer housing surfaces;

a crankshaft; and a crosshead assembly comprising:

a unitary crosshead slidably disposed within the housing and comprising:

a first crosshead surface slidably engaging the inner housing surface;

a second crosshead surface; and a first fluid passage extending between the first and second crosshead surfaces, wherein the fluid port and first fluid passage are fluidly connected; and a connecting rod operatively connecting the crankshaft with the unitary crosshead via trunnions having circumferential outer surfaces fittingly accommodated within cylindrical side openings thereof to distribute forces from the connecting rod to the unitary crosshead during reciprocating of the reciprocating pump, wherein the connecting rod comprises:

a first connecting rod surface pivotably engaging the first crosshead surface;

a second connecting rod surface pivotably engaging the crankshaft; and a second fluid passage extending between the first and second connecting rod surfaces, wherein the first and second fluid passages are fluidly connected, and wherein the fluid port and the first and second fluid passages transfer a lubricant.

19. The apparatus of claim 18 wherein the trunnions pivotably engage at least a portion of the unitary crosshead to pivotably connect the connecting rod with the unitary crosshead.

20. The apparatus of claim 18 wherein the unitary crosshead is an integrally-formed, single-piece member.

* * * * *